US009348319B1

(12) United States Patent
Genoud et al.

(10) Patent No.: US 9,348,319 B1
(45) Date of Patent: May 24, 2016

(54) CHRONOGRAPH MECHANISM AND TIMEPIECE COMPRISING THE CHRONOGRAPH MECHANISM

(71) Applicant: Société anonyme de la Manufacture d'horlogerie Audemars Piguet & Cie, Le Brassus (CH)

(72) Inventors: Mathieu Genoud, Boudevilliers (CH); Giulio Papi, La Chaux-de-Fonds (CH)

(73) Assignee: Société anonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 0 days.

(21) Appl. No.: 14/926,527

(22) Filed: Oct. 29, 2015

(30) Foreign Application Priority Data

Oct. 30, 2014 (EP) ..... 14191113

(51) Int. Cl.

| | |
|---|---|
| ***G04F 8/00*** | (2006.01) |
| ***G04F 7/08*** | (2006.01) |
| ***G07C 1/28*** | (2006.01) |
| ***G07C 1/24*** | (2006.01) |

(52) U.S. Cl.
CPC ..... *G04F 8/006* (2013.01); *G04F 7/0842* (2013.01); *G07C 1/24* (2013.01); *G07C 1/28* (2013.01)

(58) Field of Classification Search
CPC ..... G04F 8/006; G04F 7/0842; G04F 7/08; G04F 7/0876; G07C 1/28; G07C 1/24
USPC ..... 368/96
See application file for complete search history.

(56) References Cited

U.S. PATENT DOCUMENTS

| | | | | |
|---|---|---|---|---|
| 4,588,305 | A * | 5/1986 | Piguet | G04C 3/008 368/106 |
| 6,842,403 | B2 | 1/2005 | Meis | |
| 6,975,561 | B2 * | 12/2005 | Forsey et al. | G04F 7/08 368/10 |
| 2,211,243 | A1 | 4/2013 | Meis | |
| 2004/0264303 | A1 * | 12/2004 | Brida | G04F 7/08 468/110 |
| 2005/0174888 | A1 | 8/2005 | Forsey et al. | |
| 2010/0182878 | A1 * | 7/2010 | Meis | G04F 7/0876 368/81 |

FOREIGN PATENT DOCUMENTS

| | | | |
|---|---|---|---|
| DE | 101 35 110 | A1 | 2/2003 |
| EP | 1 372 117 | A1 | 12/2003 |
| EP | 2 211 243 | A2 | 7/2010 |
| WO | WO-2011/131788 | A1 | 10/2011 |

* cited by examiner

*Primary Examiner* — Sean Kayes
(74) *Attorney, Agent, or Firm* — Drinker Biddle & Reath LLP

(57) ABSTRACT

A chronograph mechanism includes an intermediate chronograph mobile which is provided for transmitting a drive to first and second sweep-hand mobiles. A first and a second return device are configured to return the first sweep-hand mobile to a first predetermined angular position relative to the intermediate chronograph mobile, in the absence of angular immobilization of the first sweep-hand mobile by a first brake, and the second sweep-hand mobile to a second predetermined angular position relative to the intermediate chronograph mobile, in the absence of angular immobilization of the second sweep-hand mobile by a second brake. A control system includes a coordination device arranged to maintain the first and second brakes alternately in two opposite configurations, in each of which one of the first and second brakes is in an inactive state and the other is in an active state.

13 Claims, 14 Drawing Sheets

FIG. 8
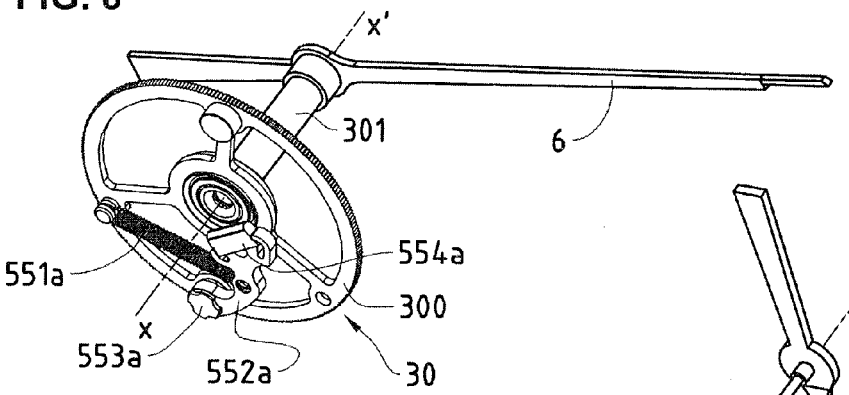
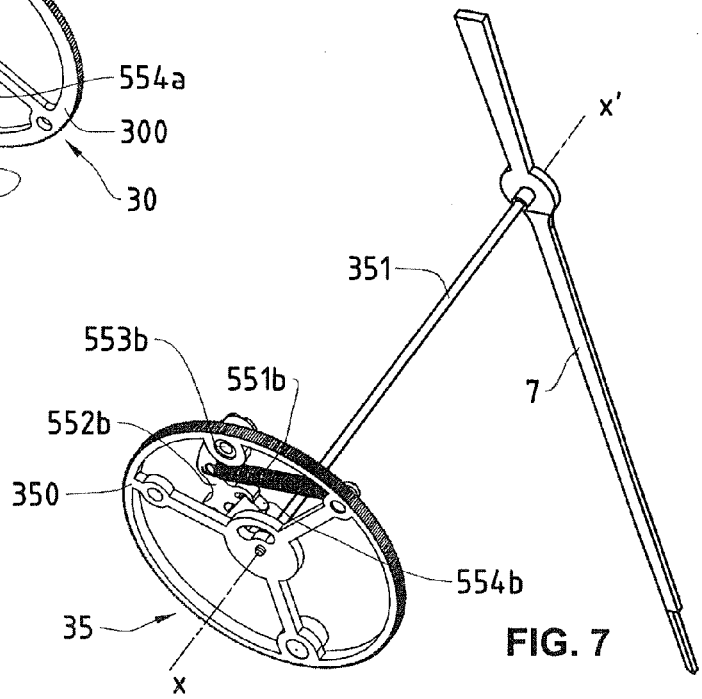
FIG. 7
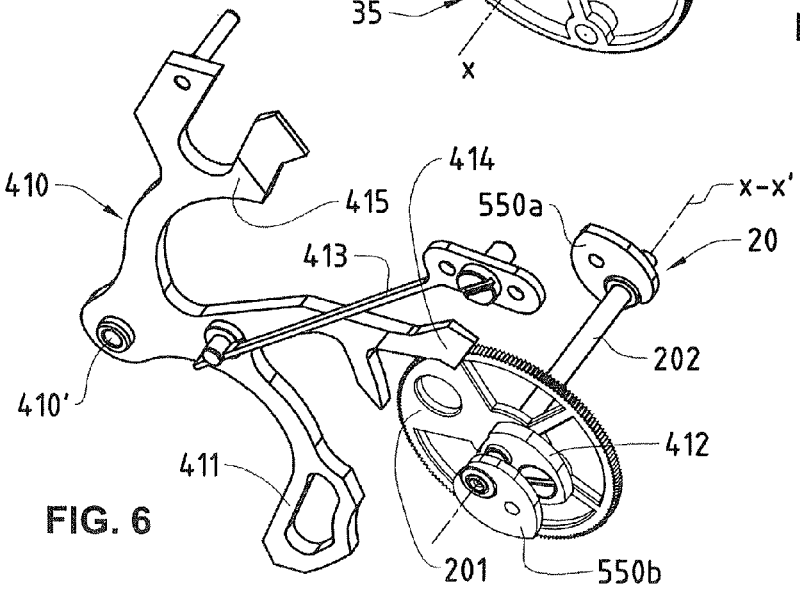
FIG. 6

CHRONOGRAPH MECHANISM AND TIMEPIECE COMPRISING THE CHRONOGRAPH MECHANISM

CROSS-REFERENCE TO RELATED APPLICATIONS

The present patent application claims priority to European Patent Application No. 1419113.1 filed on Oct. 30, 2014, the entire contents of which are herewith incorporated by reference.

FIELD OF THE INVENTION

The present invention relates to the field of watchmaking. More precisely, it relates to a chronograph mechanism and to a timepiece comprising that chronograph mechanism.

RELATED ART

European patent application EP 1 372 117 describes a watch comprising a chronograph mechanism which is able to measure two times, each of which is constituted by an addition of time periods. The time periods constituting one of those two times alternate with the time periods constituting the other time, which corresponds to the situation of two players facing one another and each taking his turn. The chronograph mechanism proposed in patent application EP 1 372 117 can thus be used in certain games such as chess, where the accumulated playing times of each of two players playing alternately is counted.

In other words, the chronograph mechanism proposed in patent application EP 1 372 117 is adapted to a particular type of situation, outside of which it is unusable. For example, the chronograph mechanism proposed in patent application EP 1 372 117 is not adapted to monitor and compare the successive lap times of the same competitor moving round a closed circuit, that is to say the performances achieved by such a competitor lap after lap.

There are additionally known chronograph mechanisms referred to as rattrapante mechanisms, by virtue of which two sweep hands are able to turn together in a superposed state until one of them is stopped to indicate an intermediate time while the other sweep hand continues to measure the time. Of those two sweep hands, the rattrapante hand is the sweep hand which can be stopped without the other sweep hand also being stopped. Each of the two sweep hands is mounted on one of two coaxial shafts, one of which carries a heart cam. A rattrapante wheel on the other shaft is provided with a lever. The lever cooperates with the edge of the heart cam in order to place the rattrapante wheel in the same angular position as the heart cam, except when a claw clamps the rattrapante wheel and blocks it.

In U.S. Pat. No. 6,842,403 there is described a rattrapante mechanism which is perfected in that the rattrapante hand and the other sweep hand can be the object of a simultaneous flyback.

In international patent application WO 2011/131788 there is proposed a rattrapante mechanism which is characterized by the addition of a clutch between the shaft carrying the rattrapante wheel and the shaft carrying the sweep second hand other than the rattrapante hand, by virtue of which secondary timing which is to take place during main timing can be started after the latter.

Document EP 2 211 243 A2 proposes adding a second rattrapante to a chronograph which already includes a rattrapante and a chronograph hand. The architecture of the body includes three coaxial shaft, including a chronograph shaft carrying the chronograph hand. The two other shafts each carry a rattrapante. They are rattrapante shafts which can each be immobilized by one of two claws. Two return devices having a heart cam and a lever are likewise provided. Each of those devices is capable of returning one of the rattrapante shafts to a predetermined angular position relative to the chronograph shaft.

SUMMARY OF THE INVENTION

According to one aspect of the present invention, a chronograph mechanism for a timepiece comprising a watch movement is provided. The chronograph mechanism preferably includes a first sweep-hand mobile which is provided for carrying a first sweep hand for indicating a measured time, as well as a second sweep-hand mobile which is provided for carrying a second sweep hand for indicating a measured time. The first and the second sweep-hand mobiles preferably rotate on the same axis of rotation. Preferably, a first brake is capable of angularly immobilizing the first sweep-hand mobile. Preferably, a second brake is capable of angularly immobilizing the second sweep-hand mobile. An intermediate chronograph mobile which rotates on the same axis of rotation as the first and second sweep-hand mobiles is preferably arranged to transmit a drive from the watch movement to the first and second sweep-hand mobiles. Preferably, a first return device is capable of returning the first sweep-hand mobile to a predetermined angular position relative to the intermediate chronograph mobile in the absence of angular immobilization of the first sweep-hand mobile by the first brake. Preferably, a second return device is capable of returning the second sweep-hand mobile to a predetermined angular position relative to the intermediate chronograph mobile in the absence of angular immobilization of the second sweep-hand mobile by the second brake. Preferably, a control system is capable of controlling the states of the first and second brakes. The control system preferably includes a coordination device which is arranged to maintain the first and second brakes in alternative first and second configurations. In the first configuration, the first brake is in an inactive state, thereby allowing the first sweep-hand mobile to rotate freely, and the second brake is in an active state, thereby angularly immobilizing the second sweep-hand mobile. In the second configuration, the second brake is in an inactive state, thereby allowing the second sweep-hand mobile to rotate freely, and the first brake is in an active state, thereby angularly immobilizing the first sweep-hand mobile.

One object of the features of the invention is to provide novel possibilities or to permit more simple use as regards the timing of a plurality of events in situations where those events are related to one another in a particular manner.

The chronograph mechanism defined above allows the result of a first completed time measurement to be displayed and a second time measurement to be carried out simultaneously.

The chronograph mechanism defined above can be configured in different ways, especially by the presence or absence of one or more additional features which can be chosen especially from those specified hereinbelow.

The chronograph mechanism defined above can especially be configured in such a manner that it can be employed for carrying out and visually comparing two successive time measurements.

In particular, the chronograph mechanism defined above can be configured in such a manner that it can be employed at least for carrying out and visually comparing the time measurements of events which take place in succession without interruption, such as successive laps of a driver travelling round a closed circuit, or which follow one another with an interval between them.

Likewise, the chronograph mechanism defined above can be configured in such a manner that it can be employed at least for carrying out and visually comparing the time measurement of a reference event and the time measurement of an event that starts shortly after the end of the reference event. Likewise, the chronograph mechanism defined above can be configured in such a manner that it can be employed at least for carrying out and visually comparing the time measurement of a reference event and the time measurement of an event that starts immediately after the reference event. The reference event can be, for example, the best performance, over one lap, of a driver completing laps on a closed circuit. The reference event can also be, for example, the performance of a forerunner on a piste or the best performance from those of a number of competitors following one another on the same course without any overlap between their respective runs, as is the case in skiing competitions.

Likewise, the chronograph mechanism defined above can be configured in such a manner that it at least allows the result of a first completed time measurement to be displayed and a second time measurement which does not have the same starting point as the first time measurement to be carried out simultaneously. Likewise, the chronograph mechanism defined above can be configured in such a manner that it at least allows the result of a first completed time measurement to be displayed and a second time measurement which has the same starting point as the first time measurement to be carried out simultaneously. Likewise, the chronograph mechanism defined above can be configured in such a manner that it at least then allows the result of the second time measurement, once it has been completed, to be displayed and a third time measurement which has the same starting point as the first and the second time measurements to be carried out simultaneously.

The chronograph mechanism defined above can incorporate one or more other advantageous features, in isolation or in combination, in particular among those specified hereinbelow.

Advantageously, the chronograph mechanism includes a clutch for coupling the intermediate chronograph mobile to the watch movement. The control system is capable of placing the clutch alternately in an engaged state and in a disengaged state.

Advantageously, the chronograph mechanism includes a restoring device for restoring the intermediate chronograph mobile.

Advantageously, the chronograph mechanism includes a flyback mechanism arranged to restore the intermediate chronograph mobile on the fly by disengaging said clutch for a brief moment and actuating the restoring device during that brief moment. When that is the case, the chronograph mechanism can be employed especially for carrying out and comparing the time measurements of events which follow one another without interruption.

Advantageously, the coordination device includes a first column wheel for selecting the state of the first brake from two opposite states, namely the inactive and active states of the first brake, as well as a second column wheel for selecting the state of the second brake from two opposite states, namely the inactive and inactive states of the second brake. Preferably, each manoeuvre of the first column wheel by one step reverses the state of the first brake. Preferably, each manoeuvre of the second column wheel by one step reverses the state of the second brake. Preferably, the first and second column wheels are out of phase by one step relative to one another so as to place the first and second brakes in opposite states. Preferably, the control system is arranged to actuate the first and second column wheels together by one step when instructed to reverse the configuration of the first and second brakes between the first and second configurations. A coordination device configured in this manner can be integrated into a timepiece such as a watch and be effective therein in practice for performing the desired functions.

Advantageously, the coordination device is arranged to maintain the first and second brakes in three alternative configurations, namely the first configuration, the second configuration, and a third configuration in which the first and second brakes are in their respective inactive states, allowing the first and second sweep-hand mobiles to rotate freely.

Advantageously, the control system includes:

- a first control mechanism capable of converting a first manual instruction into a first actuation which reverses the state of the clutch between its engaged and disengaged states, and
- a second control mechanism capable of converting a second manual instruction at least into a second actuation which reverses the configuration of the first and second brakes between their first and second configurations.

Advantageously, the second control mechanism is capable of converting the second manual instruction into two actuations, namely said second actuation and a third actuation which follows the second actuation and leads the flyback mechanism to restore the intermediate chronograph mobile on the fly, unless the intermediate chronograph mobile is already at zero.

Advantageously, the control system is capable of converting a third manual instruction into the third actuation without causing the second actuation.

Advantageously, the second control mechanism is capable of converting the second manual instruction into the second actuation without causing a third actuation which leads the restoring device to restore the intermediate chronograph mobile.

Advantageously, the first control mechanism is capable of converting the first manual instruction into two actuations, namely the first actuation and another actuation which brings the first and second brakes into the third configuration, unless the first and second brakes are already in the third configuration. Preferably, the second actuation brings the first and second brakes out of the third configuration, unless the first and second brakes are already in one of the first and second configurations.

Advantageously, the control system is capable of converting a third manual instruction into a third actuation which leads the restoring device to restore the intermediate chronograph mobile, unless the intermediate chronograph mobile is already at zero.

An embodiment of the invention relates also to a timepiece comprising:

- a watch movement,
- at least first and second sweep hands, and
- a chronograph mechanism as defined hereinbefore, the intermediate chronograph mobile of which is capable of receiving a drive from the watch movement, the first and second sweep-hand mobiles carrying the first and second sweep hands, respectively.

BRIEF DESCRIPTION OF THE DRAWINGS

Other advantages and features will become more clearly apparent from the following description of particular embodiments of the invention which is given by way of a non-limiting example and is shown in the accompanying drawings, in which:

FIG. 6 is a perspective view showing an intermediate chronograph mobile which forms part of the sub-body of FIG. 5, and a hammer for restoring the intermediate chronograph mobile;

FIG. 7 is a perspective view of a first sweep hand carried by a sweep-hand mobile which forms part of the sub-body of FIG. 5;

FIG. 8 is a perspective view of a second sweep hand carried by a sweep-hand mobile which also forms part of the sub-body of FIG. 5;

FIG. 10 is the bottom part of the sectional view of which FIG. 9 is the top part;

DETAILED DESCRIPTION OF THE PREFERRED EMBODIMENTS

Description of a First Embodiment of the Invention

Figure 1:
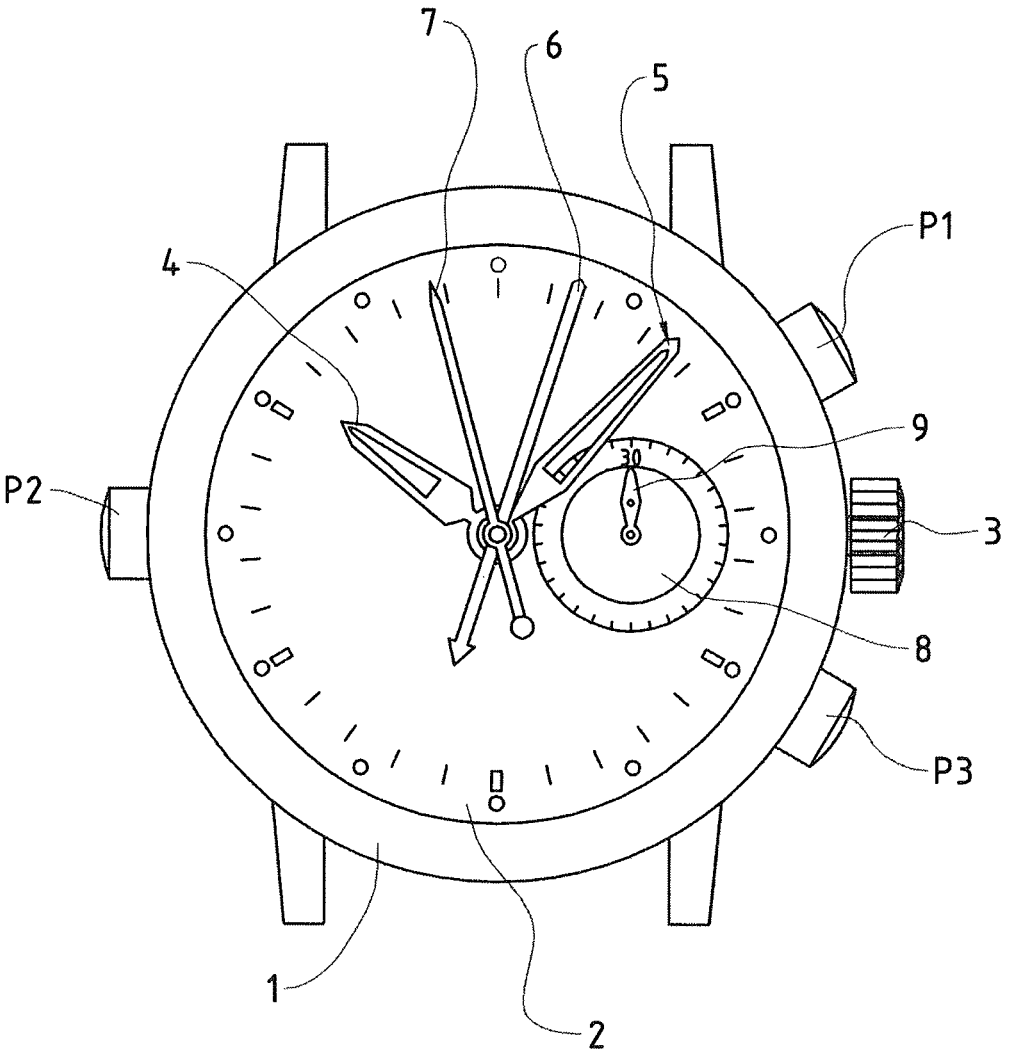
FIG. 1 shows a watch according to an embodiment of the invention.

FIG. 1 shows part of a watch according to an embodiment of the invention. Conventionally, the watch includes a casing 1 closed by a glass which is transparent and thus not shown, a dial 2 mounted behind the transparent glass, a winding and time-setting crown 3, an hour hand 4 and a minute hand 5.

The watch of FIG. 1 further includes means for displaying time measurements, including two hands for indicating timed seconds, namely a lower sweep hand 6 and an upper sweep hand 7, as well as a small dial 8 with which there is associated a timed-minute hand 9. A chronograph mechanism according to a first embodiment of the invention drives the hands 6, 7 and 9. Its operation is controlled manually by way of three pushbuttons, namely a first start/stop button P1 for starting and stopping timing, a second button P2 and a third restoring button P3.

Figure 2:
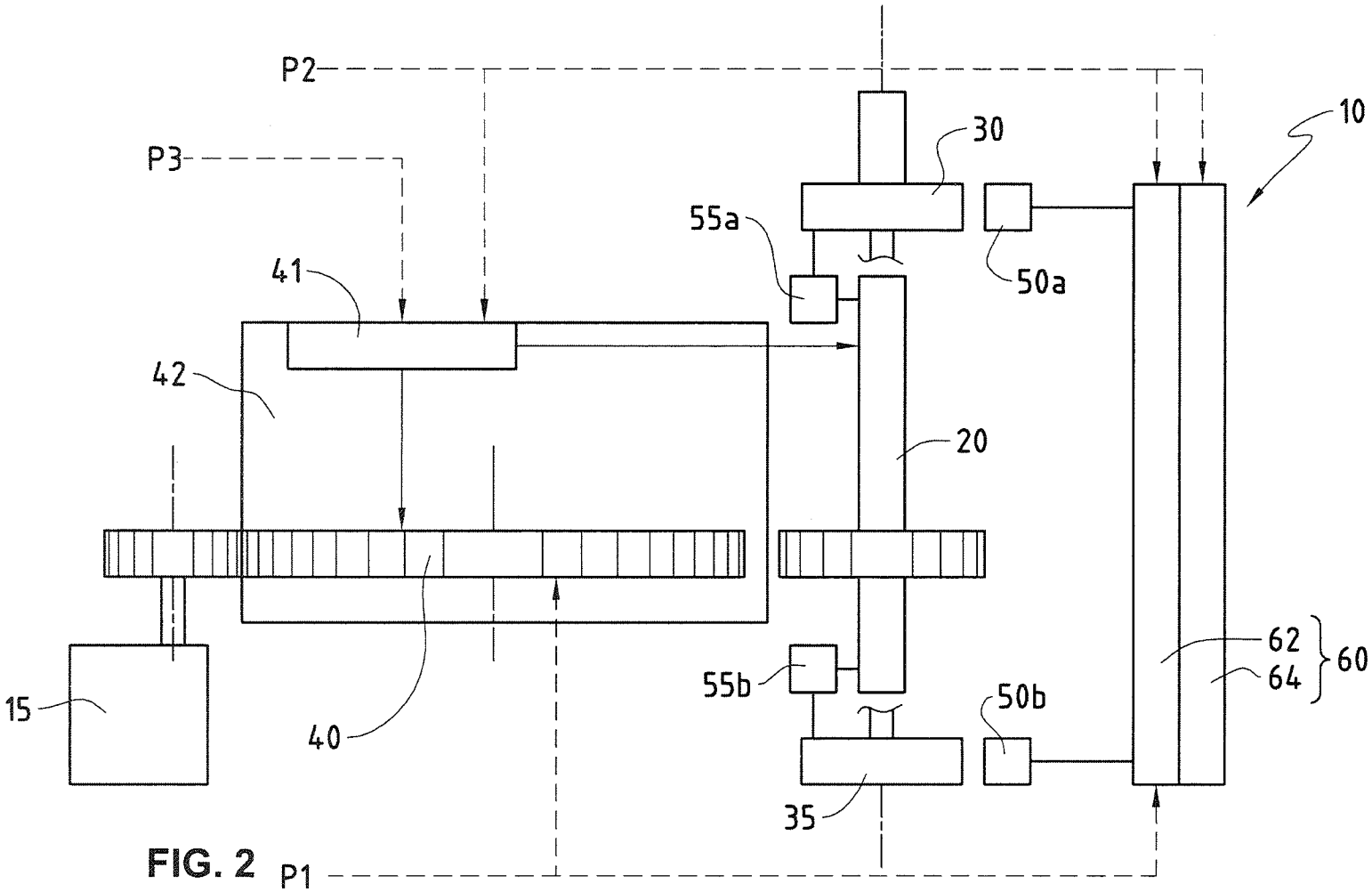
FIG. 2 is a simplified diagram of the general architecture of a chronograph mechanism according to a first embodiment of the invention with which the watch of FIG. 1 is provided.

The chronograph mechanism controlled by the buttons P1, P2 and P3 has the reference numeral 10 and is shown schematically in FIG. 2. It is driven by a conventional watch movement 15 known per se, which counts the current time and, in that respect, has a first function of driving the hands 4 and 5.

The chronograph mechanism 10 includes three mobiles which rotate on the same axis of rotation and which are an intermediate chronograph mobile 20 provided for transmitting the drive originating from the watch movement 15, a sweep-hand mobile 30 carrying the sweep hand 6, and a sweep-hand mobile 35 carrying the sweep hand 7. A clutch 40 known per se makes it possible to choose whether or not to couple the intermediate chronograph mobile 20 to the watch movement 15.

The intermediate chronograph mobile 20 can also be actuated by a restoring device 41. The restoring device 41 and the clutch 40 form part of a flyback mechanism 42 by virtue of which, when it is driven, the intermediate chronograph mobile 20 can be restored and then immediately driven again. In the flyback mechanism 42, the restoring device 41 is designed to disengage the clutch 40 for a brief moment and to restore or initialize the intermediate chronograph mobile 20 during that brief moment. The flyback mechanism 42 and its components 40 and 41 are known per se and will not be described in detail here.

In a variant, the flyback mechanism 42 can comprise a control mechanism which is capable of coordinating a restoring of the intermediate chronograph mobile 20 on the fly by disengaging the clutch 40 for a brief moment and actuating the restoring device 41 during that brief moment. In this case, the brief moment for which the clutch 40 is disengaged can be independent of the duration of the manual push that effects actuation of the flyback mechanism 42.

A brake 50*a* and a return device 55*a* are associated with the sweep-hand mobile 30. The return device 55*a* is provided to return the sweep-hand mobile 30 to a predetermined angular position relative to the intermediate chronograph mobile 20 when the brake 50*a* is inactive. In particular, when the brake 50*a* is inactive, the return device 55*a* connects together the sweep-hand mobile 30 and the intermediate chronograph mobile 20, which are then able to turn together in the same movement. When it is active, the brake 50*a* immobilizes the sweep-hand mobile 30 in an angular position, even if the intermediate chronograph mobile 20 is moving or is stopped in a different angular position.

In a similar manner, a brake 50*b* and a return device 55*b* are associated with the sweep-hand mobile 35. The return device 55*b* is provided for returning the sweep-hand mobile 35 to a predetermined angular position relative to the intermediate chronograph mobile 20 when the brake 50*b* is inactive. In particular, when the brake 50*b* is inactive, the return device 55*b* connects together the sweep-hand mobile 35 and the intermediate chronograph mobile 20, which are then able to turn together in the same movement. When it is active, the brake 50*b* immobilizes the sweep-hand mobile 35 in an angular position, even if the intermediate chronograph mobile 20 is moving or is stopped in a different angular position.

A coordination device 60 determines the configuration of the brakes 50*a* and 50*b* from three possible configurations, two of which are opposite, as a function of the manual instructions which have been applied to the buttons P1 and P2. The coordination device 60 comprises neutralization means 62 and a reversing mechanism 64, which is provided for alternately placing the brakes 50*a* and 50*b* in the two opposite configurations when the neutralization means 62 do not maintain either of the brakes 50*a* and 50*b* in the same inactive state. In one of their opposite configurations, the brake 50*a* and the brake 50*b* are active and inactive, respectively. In their other configuration of their opposite configurations, the brake 50*a* and the brake 50*b* are inactive and active, respectively.

The coordination device 60 forms part of a control system which determines an operating logic for the chronograph mechanism as a function of the manual instructions applied to the buttons P1, P2 and P3.

Figure 3:
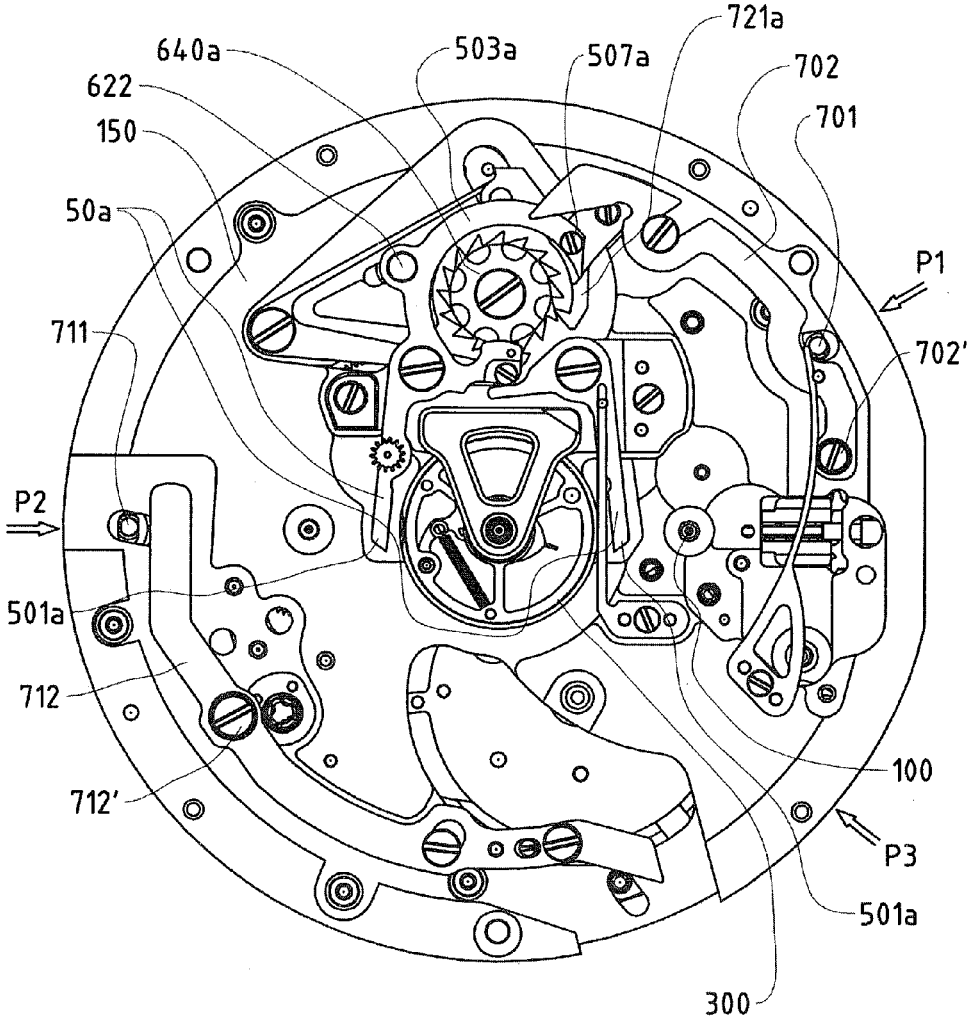
FIG. 3 is a top view (from the dial of the watch) of a body which is contained in the watch casing and which includes the chronograph mechanism of FIG. 2.
Figure 4:
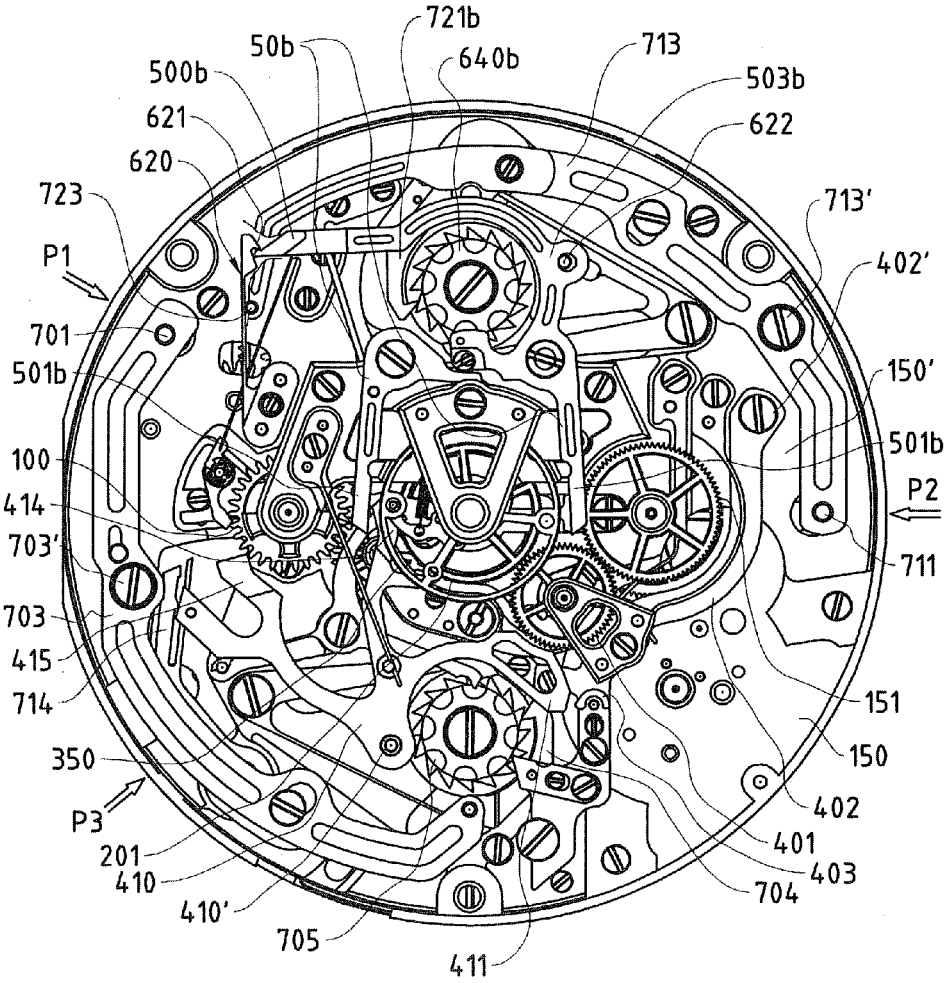
FIG. 4 is a bottom view (from the bottom of the watch) of the body shown in FIG. 3.

The casing 1 contains and protects a body which is shown in FIGS. 3 and 4. In this body, the watch movement 15 and the chronograph mechanism 10 are mounted on the same mounting plate 150. The body contained in the casing 1 has two opposite sides, which are a dial side on the side of the dial 2 and a bar side on the side of the bottom of the casing 1. The dial side is shown in FIG. 3, while the bar side is shown in FIG. 4. The chronograph mechanism 10 and the above-mentioned control system are situated in part on the dial side and in part on the bar side.

As symbolised by an arrow in FIGS. 3 and 4, the button P1 is capable of pushing a dual transmission pin 701 and thus simultaneously manoeuvring two control members, which are a control member 702 mounted on the dial side so as to pivot at 702' and a control member 703 mounted on the bar side so as to pivot at 703'. As will be explained hereinbelow, the control member 702 is provided for generating an actuation which leads to activation of the neutralization means 62, unless the neutralization means 62 are already active. The control member 703 carries a hook 704 which is capable of manoeuvring a clutch column wheel 705 which determines the engaged or disengaged state of the clutch 40.

As symbolised by an arrow in FIGS. 3 and 4, the button P2 is capable of pushing a dual transmission pin 711 and thus manoeuvring two control members, which are a control member 712 mounted on the dial side so as to pivot at 712' and a control member 713 mounted on the bar side so as to pivot at 713'. The control member 713 is provided for acting on the coordination device 60 in a manner that will be specified hereinbelow. The control member 712 is capable of manoeuvring a restoring lever 714 which is situated on the bar side and is provided for actuating a restoring hammer 410. The restoring hammer 410, which pivots at 410' as can be seen in FIG. 4, is a component of the restoring device 41.

As symbolised by an arrow in FIGS. 3 and 4, the button P3 is capable of manoeuvring the restoring lever 714, in the same manner as the control member 712.

The returns of the control members 702, 703, 712 and 713 by resilient bodies take place in the opposite directions to their manoeuvring directions following pushes of the buttons P1, P2 and P3. The returns are not shown in detail here for the sake of clarity.

In FIG. 3, the brake 50*a* is constituted by a claw which is situated on the dial side and is able to immobilize a wheel 300 of the sweep-hand mobile 30 by clamping the wheel 300 between its two jaws.

In FIG. 4, the brake 50*b* is constituted by a claw which is situated on the bar side and is able to immobilize a wheel 350 of the sweep-hand mobile 35 by clamping the wheel 350 between its two jaws.

Situated on the dial side and visible in FIG. 3, a column wheel 640*a* of the reversing mechanism 64 determines the state of the brake 50*a* in a manner specified hereinbelow, in the absence of neutralization of its action by the neutralization means 62. Situated on the bar side and visible in FIG. 4, a column wheel 640*b* of the reversing mechanism 64 determines the state of the brake 50*b* in a manner specified hereinbelow, in the absence of neutralization of its action by the neutralization means 62. In FIG. 4, the neutralization means 62 include a resiliently flexible finger 620, the free end of which forms a catching tooth 621 with which there engages a beam 500*b* of the brake 50*b* when the neutralization means 62 are active.

In FIG. 4, the clutch 40 includes a clutch wheel 401 which meshes with a drive wheel 151 driven by the watch movement 15. A clutch rocker 402 pivoting at 402' carries the clutch wheel 401. Its position is determined by the clutch column wheel 705, in a manner known per se. According to that position, the clutch wheel 401 does or does not mesh with a toothed wheel 201 of the intermediate chronograph mobile 20 and thus does or does not couple the intermediate chronograph mobile 20 to a drive originating from the watch movement 15. In addition to the clutch column wheel 705, the restoring hammer 410 is able to actuate the clutch rocker 402. More precisely, an arm 411 of the restoring hammer 410 is provided for pushing a lug 403 provided on the clutch rocker 402 and thus maintaining the clutch 40 away from the toothed wheel 201 while the restoring hammer 410 restores the intermediate chronograph mobile 20.

Still in FIG. 4, reference numeral 100 denotes the timed-minutes mobile, that is to say the mobile carrying the minute hand 9. During timing, the timed-minutes mobile 100 is driven by the intermediate chronograph mobile 20 in a manner known per se. During a restoring operation, it is temporarily uncoupled from the intermediate chronograph mobile 20 in a manner which is likewise known per se.

Figure 5:
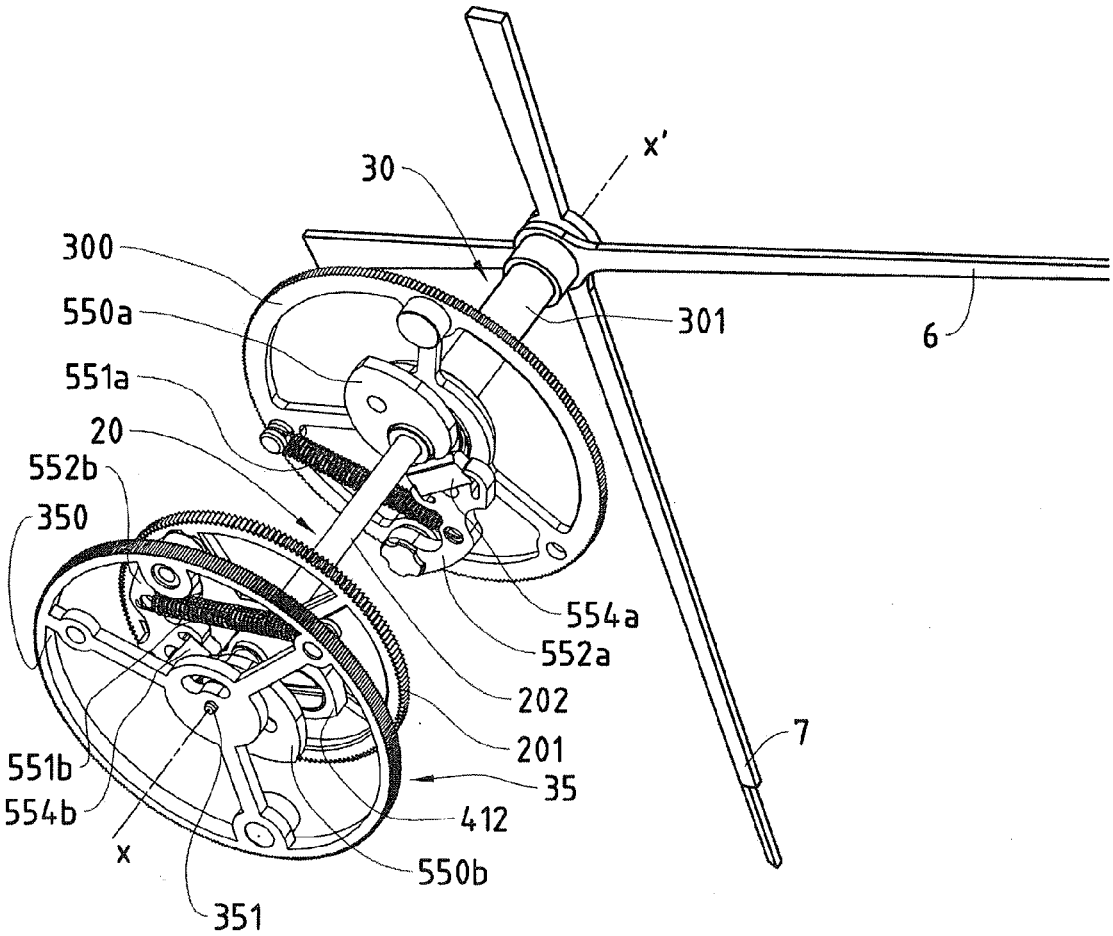
FIG. 5 is a perspective view of a sub-body of the chronograph mechanism of FIG. 2.

In FIG. 5, the intermediate chronograph mobile 20, the sweep-hand mobile 30 provided with the sweep hand 6, and the sweep-hand mobile 35 provided with the sweep hand 7 are assembled as they are in the body of FIGS. 3 and 4. They are dissociated and shown separately in FIGS. 6 to 8.

In FIG. 6 in particular, the intermediate chronograph mobile 20 and the restoring hammer 410 are shown as they are relative to one another when a return spring 413 holds the restoring hammer 410 in a waiting position. The intermediate chronograph mobile 20 includes a hollow shaft 202 to which there are connected the toothed wheel 201, a heart cam 412 of the restoring device 41, as well as two other heart cams, namely a heart cam 550*a* of the return device 55*a* and a heart cam 550*b* of the return device 55*b*. The heart cam 412 is intended to be struck laterally by a striking arm 414 of the restoring hammer 410 and thus to be pushed towards its starting position, in order that the body of the intermediate chronograph mobile 20 is initialized when the restoring hammer 410 is actuated.

Still in FIG. 6, the restoring hammer 410 has another striking arm 415, a free end of which is intended to strike a heart cam, which is not shown and is known per se, of the timed-minutes mobile 100 during a restoring operation. Each operation of restoring the intermediate chronograph mobile 20 is accompanied by a concomitant restoring of the timed-minutes mobile 100 owing to the fact that the two restoring operations are produced by the same restoring hammer 410.

In FIG. 7, the sweep-hand mobile 35 includes a shaft 351 which connects the sweep hand 7 to the wheel 350 and which fits into the hollow shaft 202 and into the sweep-hand mobile 30 when the sub-body of FIG. 5 is assembled within the body of FIGS. 3 and 4. The wheel 350 carries a helical extension spring 551*b* and a return lever 552*b*, which is mounted in a rocking manner at 553*b* and is pulled inwards by the helical spring 551*b*. In FIG. 7, the return lever 552*b* is shown in its position at the end of its inward travel, as if it were against the heart cam 550*b* and thus prevented from rocking further inwards. In the region of its free end, the return lever 552*b* has an attached shoe 554*b*.

In FIG. 8, the sweep-hand mobile 30 includes a hollow shaft 301 which connects the sweep hand 6 to the wheel 300. The wheel 300 carries a helical extension spring 551*a* and a return lever 552*a*, which is mounted in a rocking manner at 553*a* and is pulled inwards by the helical spring 551*a*. In FIG. 8, the return lever 552*a* is shown in its position at the end of its inward travel, as if it were against the heart cam 550*a* and thus prevented from rocking further inwards. In the region of its free end, the return lever 552*a* has an attached shoe 554*a*.

In FIG. 5, the shafts 202, 301 and 351 are coaxial and centred on the same axis of rotation x-x', which is a common axis of rotation about which the intermediate chronograph mobile 20, the sweep-hand mobile 30 and the sweep-hand mobile 35 rotate while being able to turn together in the same movement or alternatively relative to one another.

Like the heart cam 550*a*, the helical extension spring 551*a* and the return lever 552*a* form part of the return device 55*a*, the components of which cooperate operationally in FIG. 5 and which is similar to the return devices employed in conventional rattrapante devices. The shoe 554*a* is pushed against the edge of the heart cam 550*a*. The shoe 554*a* is pushed against the heart cam 550*a* according to an axis which intersects the axis of rotation x-x' when the sweep-hand mobile 30 is in its predetermined angular position relative to the intermediate chronograph mobile 20, as is the case in FIG. 5. On the other hand, when the sweep-hand mobile 30 is offset angularly from its predetermined angular position relative to the intermediate chronograph mobile 20, the axis according to which the shoe 554*a* is pushed against the heart cam 550*a* extends at a distance from the axis of rotation x-x', which manifests itself as a torque about the axis of rotation x-x'. The torque returns the sweep-hand mobile 30 to its predetermined angular position relative to the intermediate chronograph mobile 20 by sliding of the shoe 554*a* on the edge of the heart cam 550*a*, since the sweep-hand mobile 30 is not immobilized angularly by the brake 50*a*.

Like the heart cam 550*b*, the helical extension spring 551*b* and the return lever 552*b* form part of the return device 55*b*, the components of which cooperate operationally in FIG. 5 and which has the same structure and the same functioning as the return device 55*a*.

Figure 9:
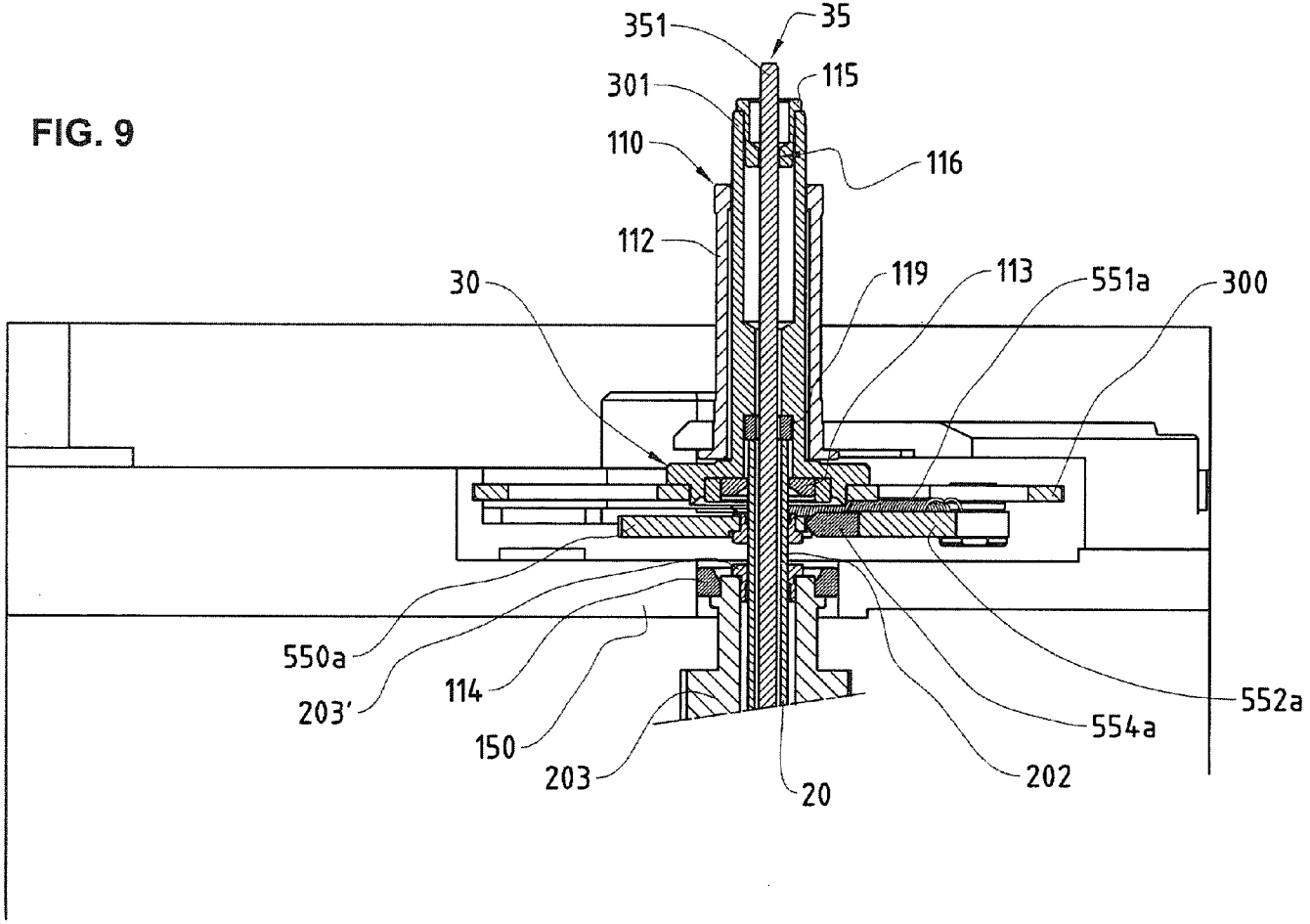
FIG. 9 is the top part of a sectional view according to a plane which passes through the axis of rotation of the sub-body of FIG. 5.

As can be seen in FIG. 9, the sweep-hand mobile 30 is guided at the top in the region of a plain bearing 110 including the top portion of a centring tube 112. The sweep-hand mobile 30 is guided at the bottom by a jewel 113 which is fixed to the sweep-hand mobile 30 and which forms a plain bearing with the hollow shaft 202 of the intermediate chronograph mobile 20.

Still in FIG. 9, the sweep-hand mobile 35 is guided at the top by an annular element 115 which is connected to the sweep-hand mobile 30 and which forms at 116 a plain bearing with the shaft 351.

The intermediate chronograph mobile 20 is guided at the top by way of a cog 203, which is itself rotatable and which is not shown in FIGS. 5 and 6 for the sake of clarity. More precisely, the top portion of the hollow shaft 202 is guided in rotation by an annular element 203' with which it forms a plain bearing, the annular element 203' being integral with the cog 203. A jewel 114, fixed to the plate 150, and a jewel 997 together guide the cog 203 in rotation. Visible only in FIG. 10, the jewel 997 is carried by a frame 150' which is rigidly associated with the plate 150.

Figure 10:
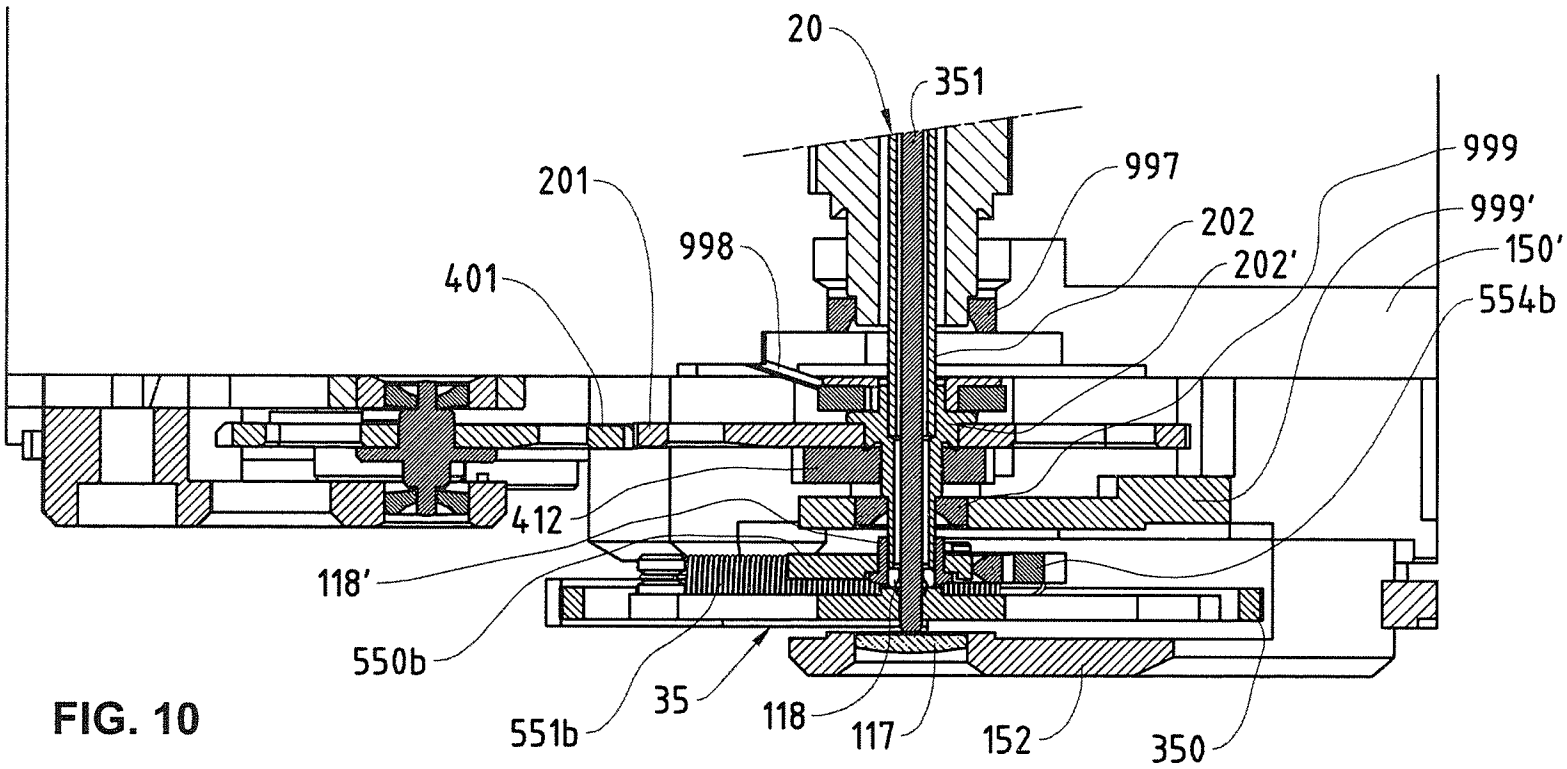

In FIG. 10, the intermediate chronograph mobile 20 is guided at the bottom by a jewel 999 held by a bar 999'. The jewel 999 and an assembly tube 202' which is a component of the intermediate chronograph mobile 20 together form a plain bearing.

The sweep-hand mobile 35 is guided at the bottom by a jewel 118, with which the shaft 351 forms a plain bearing. The jewel 118 is integral with an annular element 118' which is a component of the intermediate chronograph mobile 20 and which is held by the assembly tube 202'.

The sub-body of FIG. 5 is maintained axially between the centring tube 112 and a flat jewel 117 mounted in a bar 152. In FIG. 9, the sweep-hand mobile 30 is maintained axially by the tube 112 and a jewel 119. In FIG. 10, a friction spring 998 pushes the intermediate chronograph mobile 20 in axial abutment against the jewel 999, according to a mounting solution which is known per se for some specific situations. Still in FIG. 10, the sweep-hand mobile 35 is maintained axially by the jewel 118 and the flat jewel 117.

Figure 11:
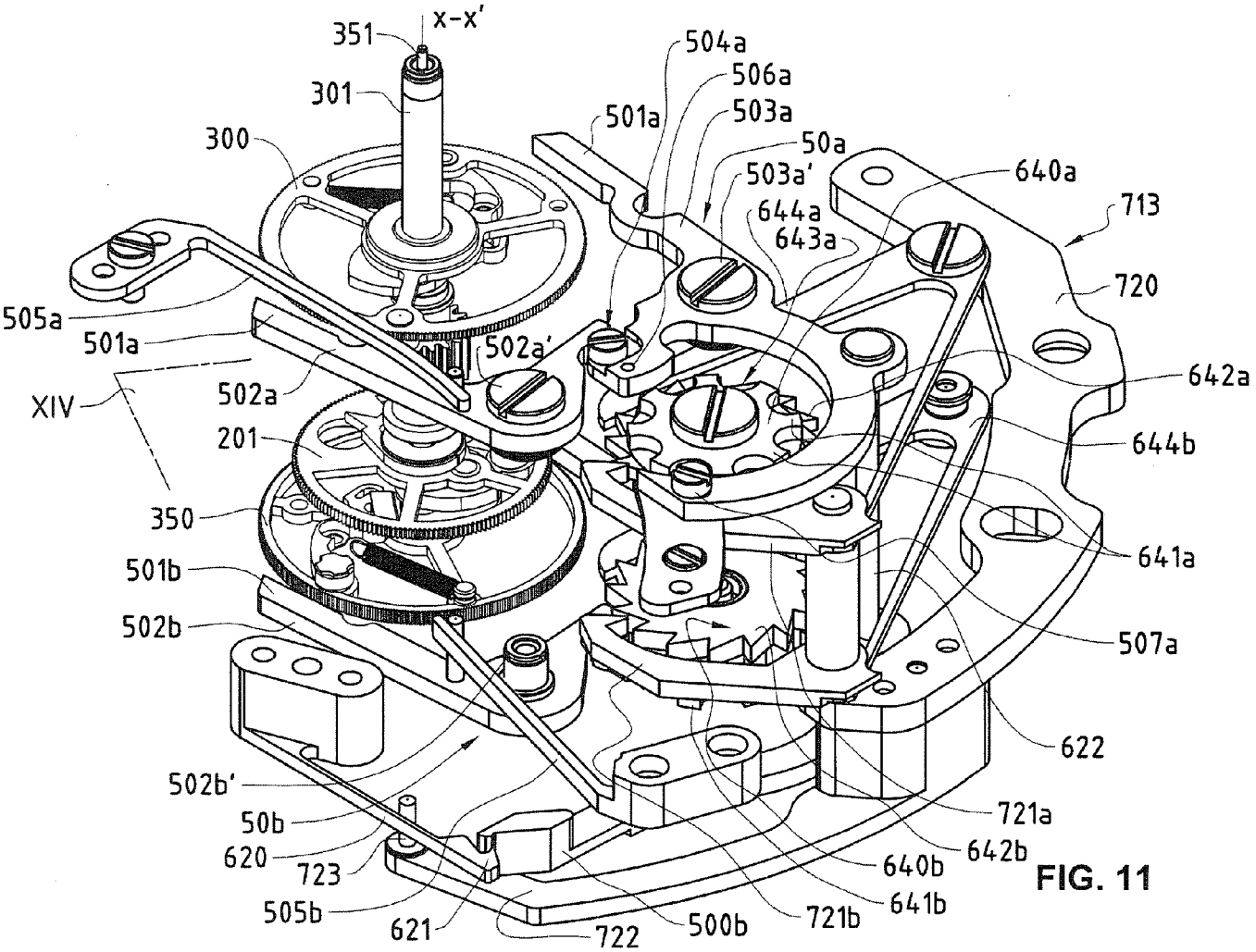
FIG. 11 is a perspective view which shows the same sub-body as FIG. 5 without the first and second sweep hands, as well as another sub-body of the chronograph mechanism of FIG. 2.
Figure 12:
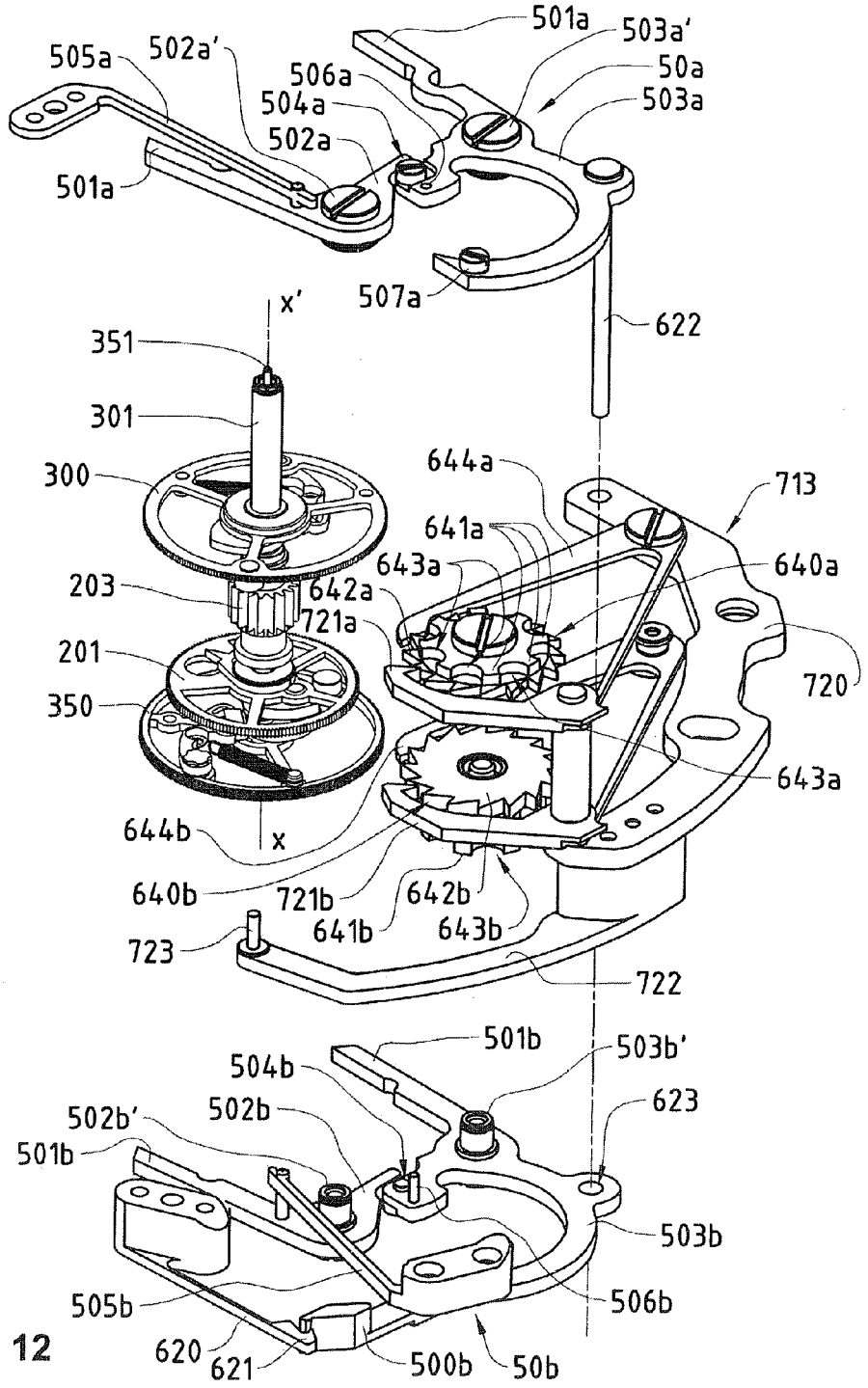
FIG. 12 is a perspective view which shows the same sub-bodies as FIG. 11 and which is identical to FIG. 11 except that it is partially exploded.

In FIG. 11, the sub-body of FIG. 5 provided with the cog 203 and without the sweep hands 6 and 7, the brakes 50*a* and 50*b*, the coordination device 60 and the control member 713 are shown as they are relative to one another within the body of FIGS. 3 and 4 when the neutralization means 62 maintain the brakes 50*a* and 50*b* in their respective inactive states. FIG. 12 is a partially exploded view of what is shown in FIG. 11.

As can be seen in FIGS. 11 and 12, the brake 50*a* includes a claw, two opposing jaws 501*a* of which are capable of immobilizing the wheel 300 by clamping it between them. One of the two jaws 501*a* is defined by a member 502*a* which pivots at 502*a*', and the other is defined by a member 503*a* which pivots at 503*a*'. A hinge 504*a* articulates the members 502*a* and 503*a* with one another. A return spring 505*a* returns the brake 50*a* to its active state by acting on the member 502*a* in the direction of a return of the jaws 501*a* towards one another. The member 503*a* carries a pin 506*a* which forms a crank pin protruding inwards in such a manner that it can be actuated towards the sweep-hand mobile 30 by the protuberances 641*a* of the column wheel 640*a*. The member 503*a* also carries a screw 507*a*, the protruding head of which forms a crank pin provided for receiving an actuation on the part of the control member 702, as will be specified hereinbelow. The member 503*a* also carries a coupling bar 622 which forms part of the neutralization means 62 by coupling the brakes 50*a* and 50*b* to one another when the neutralization means 62 place or maintain the brakes 50*a* and 50*b* in their inactive states.

The brake 50*b* is similar to the brake 50*a*. In the following, the brake 50*b* will be described only where it differs from the brake 50*a*. Moreover, a reference numeral used hereinbelow to denote a part of the brake 50*b* that is analogous or equivalent to a referenced part of the brake 50*a* is constructed by replacing the letter "a" with the letter "b" in the reference numeral denoting that part of the brake 50*a*. There are so constructed especially the reference numerals of the two jaws 501*b* which are to immobilize the wheel 350 between them by clamping, the reference numeral of the member 502*b* pivoting at 502*b*', the reference numeral of the member 503*b* pivoting at 503*b*', and the reference numerals of the hinge 504*b*, of the return spring 505*b* and of the pin 506*b*.

Figure 14:
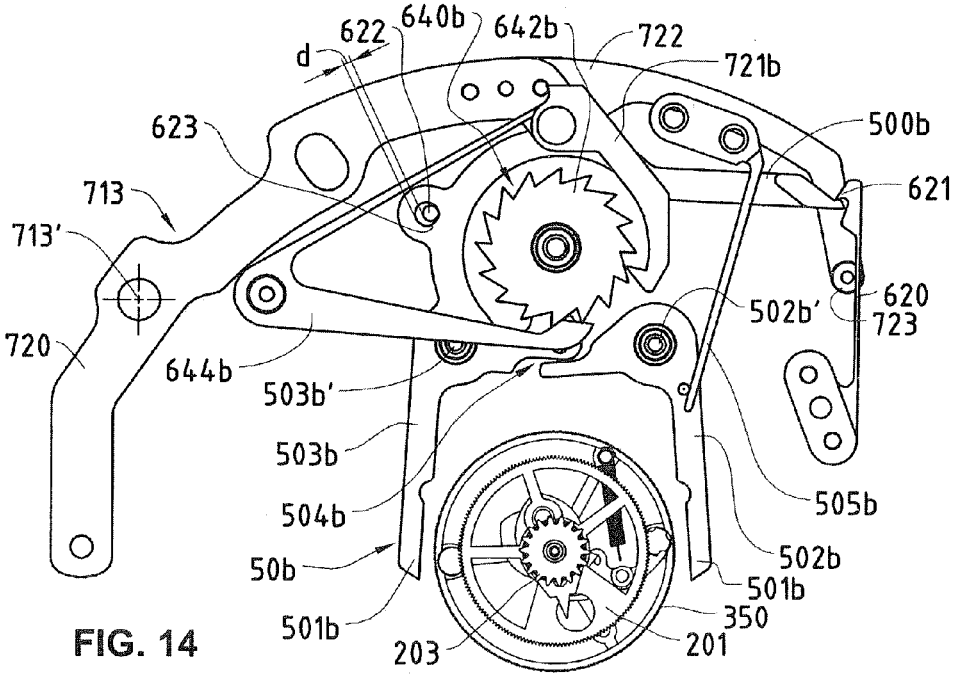
FIG. 14 is a sectional view according to plane XIV of FIG. 11.

The member 503*b* of the brake 50*b* defines the beam 500*b*. The member 503*b* does not have a screw similar to the screw 507*a*. Instead of a coupling bar similar to the coupling bar 622, the member 503*b* has a hole 623 into which the coupling bar 622 fits with play in order to have a transverse clearance therein. The clearance is visible and denoted by the letter d in FIG. 14.

The neutralization means 62 include the finger 620, the coupling bar 622 and the hole 623. In FIGS. 11 to 14, the neutralization means 62 are active owing to the fact that the free end of the beam 500*b* is engaged with the catching tooth 621 of the finger 620, which holds both the claw of the brake 50*a* and the claw of the brake 50*b* in the open position, against the return forces exerted by the return springs 505*a* and 505*b*. More precisely, the finger 620 holds the member 503*b* directly, which in turn holds the member 503*a* by way of the coupling bar 622, as can be seen by comparing FIGS. 13 and 14. The neutralization means 62 are inactive when the finger 500*b* is disengaged from the finger 620, in which case the column wheels 640*a* and 640*b* of the reversing device 64 determine the respective states of the brakes 50*a* and 50*b* which are then uncoupled from one another by virtue of the clearance d.

Again in FIGS. 11 and 12, the column wheel 640*a* includes a ratchet wheel 642*a* by means of which the column wheel 640*a* is to be driven so as to be turned by one step with each actuation received. Superposed on the ratchet wheel 642*a*, a star-shaped element of the column wheel 640*a* defines the protuberances 641*a* with which there alternate recesses 643*a* in a circumferential manner. A jumper 644*a* is provided for stabilising the column wheel 640*a* in each of its successive angular positions.

Figure 13:
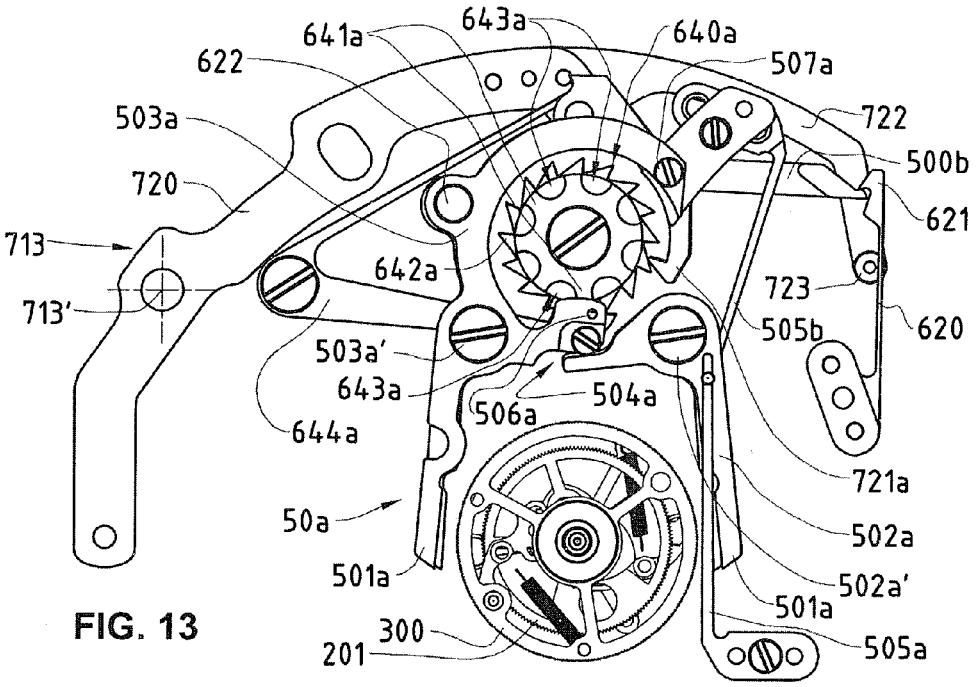
FIG. 13 is a top view showing the same sub-bodies as FIG. 11.

As can be seen in FIG. 13, the pin 506*a* is opposite a protuberance 641*a* or a recess 643*a* according to the angular position of the column wheel 640*a*. When the beam 500*b* is disengaged from the finger 620, the pin 506*a* is either resting on a protuberance 641*a* or sunk in a recess 643*a*, whatever the state of the brake 50*b*, by virtue of the clearance d. When the pin 506*a* is resting on a protuberance 641*a*, the claw of the brake 50*a* is kept open and the jaws 501*a* are away from the wheel 300. When the pin 506*a* is sunk in a recess 643*a*, the jaws 501*a* clamp the wheel 300 between them by virtue of the torque exerted by the return spring 505*a*. Pivoting of the column wheel 640*a* by one step has the effect that the recesses 643*a* take the place of the protuberances 641*a* and vice versa. In summary, the column wheel 640*a* controls the state of the brake 50*a* when the beam 500*b* is disengaged from the finger 620. The column wheel 640*a* reverses the state of the brake 50*a* between the active state and the inactive state each time it is manoeuvred by one step.

As can be seen in FIGS. 11 and 12, the column wheel 640*b* of the coordination device 60 is identical to the column wheel 640*a*. It includes a ratchet wheel 642*b* and a star-shaped element which defines protuberances 641*b* alternating with recesses 643*b* in a circumferential manner. A jumper 644*b* is provided for stabilising the column wheel 640*b* in each of its successive angular positions. When the beam 500*b* is disengaged from the finger 620, the column wheel 640*b* determines the active or inactive state of the brake 50*b*, independently of the state of the brake 50*a*, by virtue of the clearance d, in the same manner as the column wheel 640*a* determines the active or inactive state of the brake 50*a*. The column wheel 640*b* controls the state of the brake 50*b* when the beam 500*b* is disengaged from the finger 620. The column wheel 640*b* reverses the state of the brake 50*b* between the active state and the inactive state each time it is manoeuvred by one step.

The column wheels 640*a* and 640*b* are substantially centred on the same axis, which is the axis of rotation on which they both rotate. Furthermore, the column wheels 640*a* and 640*b* are offset angularly by one step relative to one another, so that the brakes 50*a* and 50*b* are always placed in opposite active and inactive states when the beam 500*b* is disengaged from the finger 620.

The control member 713 includes a beam 720 which carries two manoeuvring hooks 721*a* and 721*b*, as well as a disengagement extension 722. Situated on the dial side, the manoeuvring hook 721*a* is provided for turning the column wheel 640*a* by one step at each actuation, by pulling on one of the teeth of the ratchet wheel 642*a*. Situated on the bar side, the manoeuvring hook 721*b* is provided for turning the column wheel 640*b* by one step at each actuation, by pulling on one of the teeth of the ratchet wheel 642*b*. The two manoeuvring hooks 721*a* and 721*b* are identical and are rigidly associated with the same orientation, so as to simultaneously manoeuvre the two column wheels 640*a* and 640*b* by one step at each actuation of the control member 713. The disengagement extension 722 carries a lug 723 which is capable of resiliently bending the finger 620 away from the beam 500*b* and of thus causing the beam 500*b* to disengage from the catching tooth 621 when the control member 713 is actuated.

Figure 15:
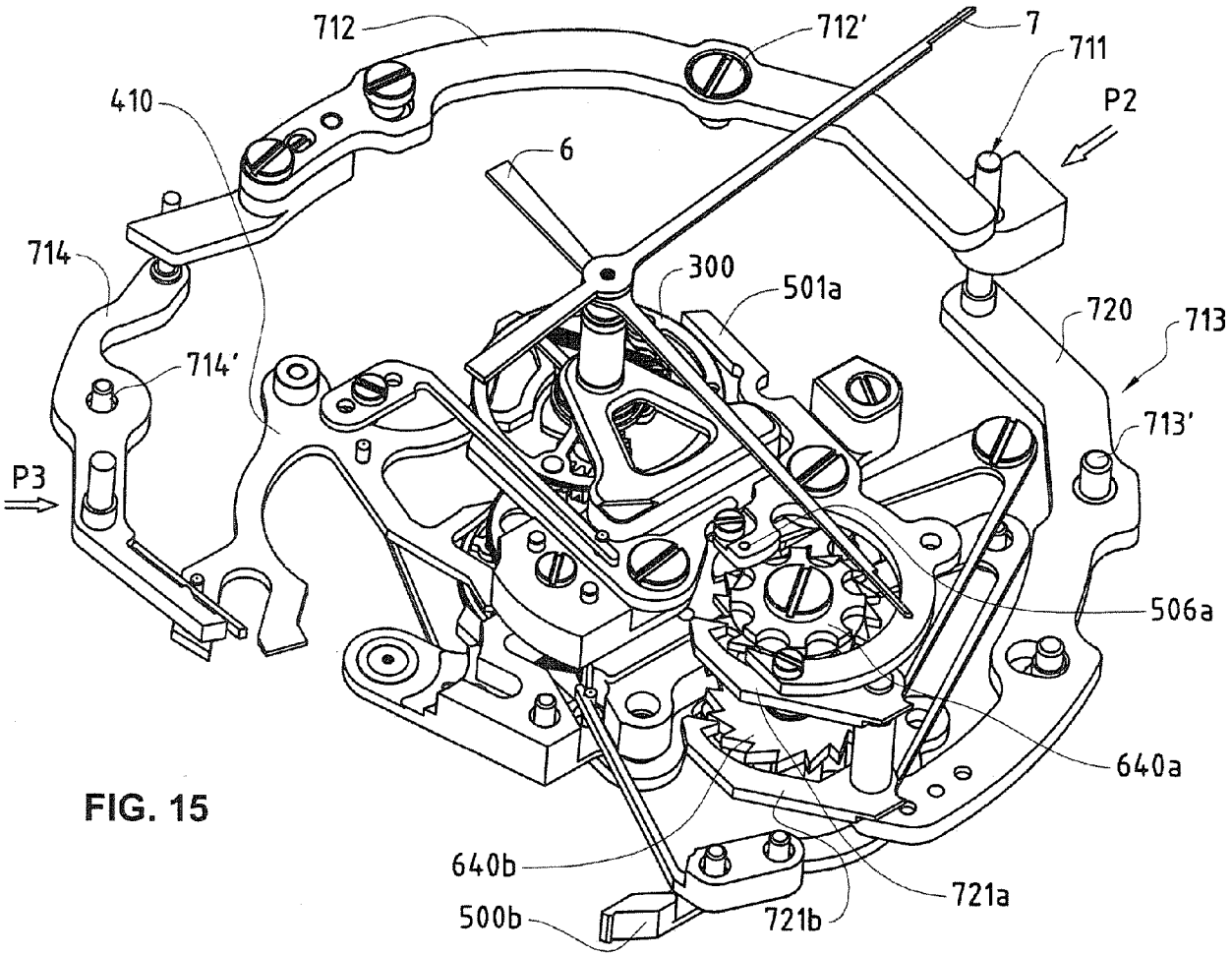
FIG. 15 is a perspective view showing a number of elements of a control system constituting the chronograph mechanism of FIG. 2, as well as other members, most of which form part of the sub-assemblies of FIG. 11.

In FIG. 15, where the disengagement extension 722 has been omitted for the sake of clarity, it can be seen how the dual transmission pin 711, the control member 712, the control member 713 and the restoring lever 714 are arranged relative to one another. Still in FIG. 15, it can be seen that the restoring lever 714 pivots at 714'.

Reference will be made to FIGS. 3 and 4 again. When the button P1 is depressed, the dual transmission pin 701 simultaneously manoeuvres the control member 702 and the control member 703. If the beam 500*b* was disengaged from the finger 620, the control member 702 then acts on the head of the screw 507*a* in such a manner that the member 503*a* of the brake 50*a* is manoeuvred in the direction of a separation of the jaws 501*a* from one another. The coupling bar 622 follows the movement of the member 503*a* and in turn drives the member 503*b* in the direction of a separation of the jaws 501*b* from one another, until the beam 500*b* passes the catching tooth 621 by pushing back the catching tooth 621. The beam 500*b* engages with the catching tooth 621 as soon as the control member 702 is returned to its initial position. If the beam 500*b* was already engaged with the finger 620 when the button P1 was pushed, the actuation of the control member 702 has no effect and the beam 500*b* remains engaged with the finger 620. When the control member 703 is manoeuvred following a push of the button P1, the hook 704 manoeuvres the clutch column wheel 705 by one step, so that the clutch 40 changes state between its engaged and disengaged states.

In summary, pushing the button P1 changes the state of the clutch 40 between its disengaged and engaged states. Pushing the button P1 further activates the neutralization means 62 if the neutralization means 62 were inactive. Pushing the button P1 leaves the neutralization means 62 as they are if the neutralization means 62 were active. The neutralization means 62 are active when they maintain the brakes 50*a* and 50*b* in the same inactive state by removing all influence on the reversing mechanism 64. The neutralization means 62 are inactive when only the reversing mechanism 64 determines the respective states of the brakes 50*a* and 50*b*.

When the button P2 is manually depressed inwards, the dual transmission pin 711 manoeuvres the control member 713 shortly before the control member 712. When the control member 713 is manoeuvred following a push of the button P2, its lug 723 pushes the finger 620 outwards and the beam 500*b* is disengaged therefrom, unless the beam 500*b* was already disengaged therefrom. Moreover, the manoeuvring hooks 721*a* and 721*b* simultaneously turn the column wheels 640*a* and 640*b* by one step. Immediately afterwards, the control member 712 pivots the restoring lever 714, which in turn actuates the restoring hammer 410. As a result, the striking arm 414 of the restoring hammer 410 strikes the heart cam 412 and thus restores the intermediate chronograph mobile 20. Similarly, the striking arm 415 of the restoring hammer 410 restores the timed-minutes mobile 100.

In summary, pushing the button P2 deactivates the neutralization means 62 if the neutralization means 62 were active. Pushing the button P2 leaves the neutralization means 62 as they are if the neutralization means 62 were inactive. Pushing the button P2 further causes the reversing mechanism 64 to reverse the states of the brakes 50*a* and 50*b*. In addition, pushing the button P2 actuates the flyback mechanism 42 and causes it to restore the intermediate chronograph mobile 20 on the fly.

When the button P3 is manually depressed inwards, the restoring lever 714 is actuated and in turn actuates the restoring hammer 410. As a result, the striking arm 414 of the restoring hammer 410 strikes the heart cam 412 and thus restores the intermediate chronograph mobile 20. Similarly, the striking arm 415 of the restoring hammer 410 restores the timed-minutes mobile 100.

In summary, pushing the button P3 actuates the flyback mechanism 42 and causes it to restore the intermediate chronograph mobile 20 as well as the timed-minutes mobile 100 on the fly. Pushing the button P3 has no effect on the state of the coordination device 60.

Figure 16:
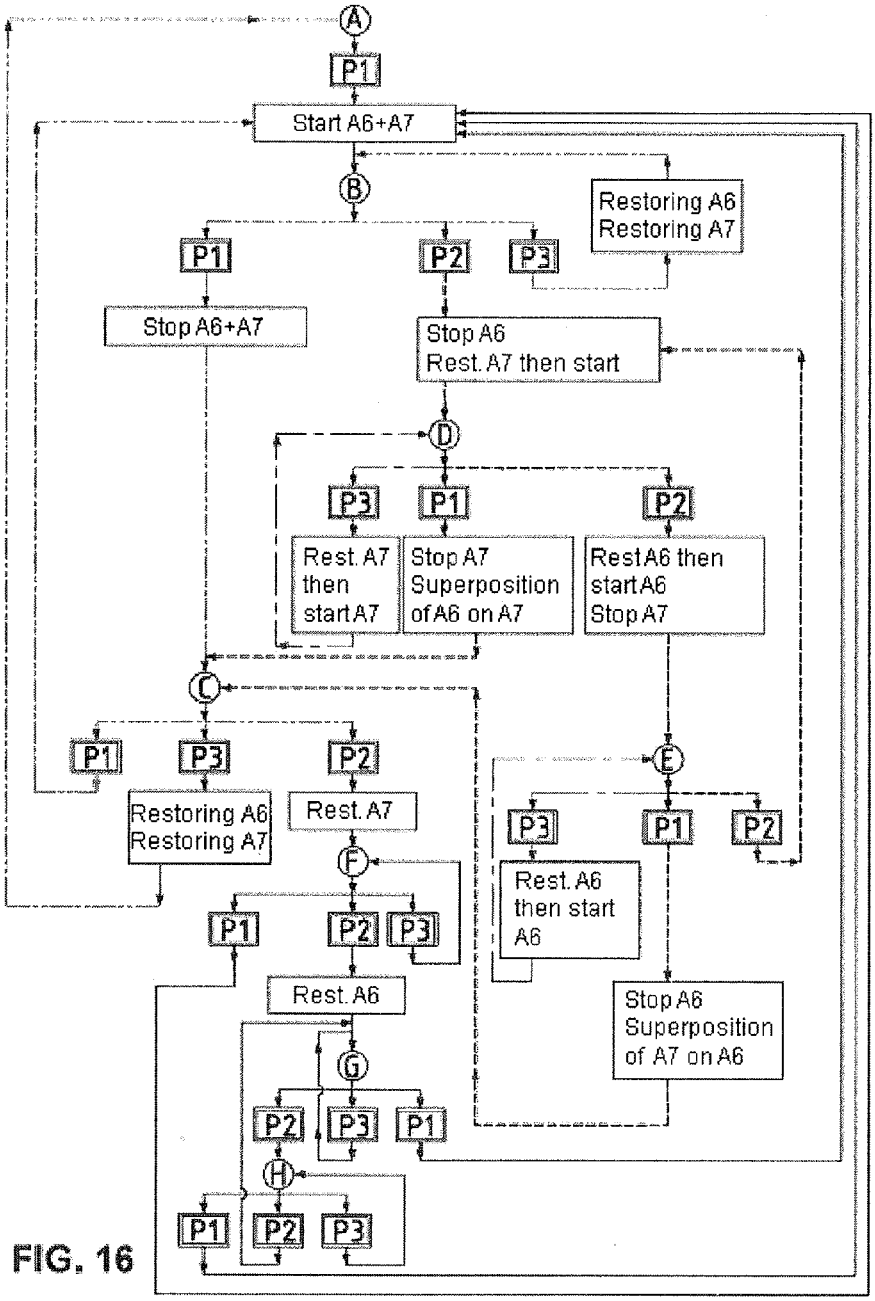
FIG. 16 is a synoptic diagram of the operating logic of the chronograph mechanism of FIG. 2.

FIG. 16 is a synoptic diagram showing the operating logic of the chronograph mechanism 10. The double-lined rectangles indicate manual instructions on the buttons P1, P2 and P3. The rectangles in single lines contain a summary of the effects produced by those manual instructions (A6 denoting sweep hand 6; A7 denoting sweep hand 7; Rest. denoting "restoring"). The manual instructions on the buttons P1, P2 and P3 bring the chronograph mechanism 10 into different states, each of which is symbolised by a circle in FIG. 16 and denoted by a capital letter.

A description of each state of the chronograph mechanism 10 is shown in the table below:

| | Bottom sweep hand 6 (A6) | Top sweep hand 7 (A7) |
|---|---|---|
| State A | Stopped, at zero, unblocked | Stopped, at zero, unblocked |
| State B | Rotating | Rotating, superposed on sweep hand A6 |
| State C | Stopped anywhere, unblocked | Stopped, superposed on sweep hand A6, unblocked |
| State D | Stopped anywhere, blocked | Rotating, just started from zero again |
| State E | Rotating, just started from zero again | Stopped anywhere, blocked |
| State F | Stopped anywhere, blocked | At zero, unblocked |
| State G | At zero, unblocked | At zero, blocked |
| State H | At zero, blocked | At zero, unblocked |

The chronograph mechanism 10 can function according to several modes, including a conventional timing type mode and a mode referred to as "LT" or "lap timer", which is peculiar thereto. In the conventional timing type mode, the sweep hands 6 and 7 remain superposed and provide the same information, and they are to be considered as forming together the single sweep hand of a conventional chronograph. In the "lap timer" mode, the sweep hands 6 and 7 are assigned to different time measurements.

State A

No timing takes place in state A, where the chronograph mechanism 10 is ready to start a first time measurement. The clutch 40 is disengaged and it isolates the mobiles 20, 30 and 35 from the watch movement 15 and from its drive. The intermediate chronograph mobile 20 is at zero, that is to say in an initial position. The neutralization means 62 are active. The brakes 50*a* and 50*b* are accordingly inactive, so that the two sweep-hand mobiles 30 and 35 are unblocked and are therefore also at zero, in the same initial position as the intermediate chronograph mobile 20. The sweep hands 6 and 7 are at zero, indicating 0 or 60 seconds. The timed-minutes hand 9 is also at zero, indicating 0 or 30 minutes.

Pushing Button P1 in State A

When button P1 (start/stop) is pushed while the chronograph mechanism is in state A, the clutch 40 changes from the disengaged state to the engaged state, after which it effects a transmission between the watch movement 15 and the intermediate chronograph mobile 20.

Pushing button P1 effects a change from state A to state B.

State B

When the chronograph mechanism 10 is in state B, the clutch 40 is engaged, while the brake 50*a* is inactive and the brake 50*b* is also inactive.

The intermediate chronograph mobile 20 is driven at the speed of one revolution per minute and in turn drives the sweep-hand mobiles 30 and 35, which are still unblocked, that is to say not immobilized by the brakes 50*a* and 50*b*.

The sweep hands 6 and 7 move at the same speed of one revolution per minute, in the same movement, while remaining superposed one on the other.

Pushing Button P1 in State B

When button P1 (start/stop) is pushed while the chronograph mechanism is in state B, the clutch 40 returns to the disengaged state. The transmission between the watch movement 15 and the intermediate chronograph mobile 20 is broken. The intermediate chronograph mobile 20 stops. The same is true of the sweep-hand mobiles 30 and 35.

Pushing button P1 again effects a change from state B to state C.

State C

When the chronograph mechanism 10 is in state C, the clutch 40 is disengaged, while the brake 50*a* is inactive and the brake 50*b* is also inactive.

The sweep hands 6, 7 and 9 indicate a measured time, namely the time that has elapsed between the two successive pushes of button P1.

Pushing Button P3 in State C

Pushing button P3 actuates the flyback mechanism 42 and therefore the restoring mechanism 41, which restores the intermediate chronograph mobile 20. The sweep-hand mobiles 30 and 35 follow the intermediate chronograph mobile 20 and are likewise restored.

Pushing button P3 effects a change from state C to state A.

Pushing Button P1 in State C

When button P1 is pushed while the chronograph mechanism is in state C, the clutch 40 changes to the engaged state. Timing resumes starting from the last indicated value.

Pushing button P1 effects a change from state A to state B.

Pushing Button P3 in State B

Pushing button P3 actuates the flyback mechanism 42. The clutch 40 is disengaged for a brief moment, during which the restoring mechanism 41 restores the intermediate chronograph mechanism 20. The sweep-hand mobiles 30 and 35 follow the intermediate chronograph mobile 20 and are likewise restored. The clutch 40 then returns to the engaged state and a new time measurement starts again from zero.

Following the pushing of button P3, the sweep hands 6 and 7 are therefore instantaneously restored and they immediately start to turn together again, while remaining superposed.

Pushing button P3 reinitializes the timing. It leaves the chronograph mechanism in state B.

As long as button P2 is not pushed, the chronograph mechanism 10 alternates between steps A, B and C. It is then in conventional timing mode, which means that it is used as a basic chronograph improved by the "flyback" functionality. Pushing button P2 effects a change to "lap timer" mode, which is particularly appropriate for monitoring the successive performances of, for example, a motor driver travelling on a closed loop.

Pushing Button P2 in State B

When button P2 is pushed while the chronograph mechanism is in state B, the neutralization means 62 are deactivated and the configuration of the brakes 50*a* and 50*b* is determined by the reversing mechanism 64. As a result, the brake 50*a* changes to the active state while the brake 50*b* remains in the inactive state. The sweep-hand mobile 30 is immediately immobilized and stops instantaneously in its current angular position.

Pushing button P2 further actuates the flyback mechanism 42, immediately after immobilization of the sweep-hand mobile 30. The clutch 40 is disengaged for a brief moment, during which the restoring mechanism 41 restores the intermediate chronograph mobile 20. Only the sweep-hand mobile 35 follows the intermediate chronograph mobile 20 as it is restored. The clutch 40 then returns to the engaged state and a new time measurement involving only the sweep-hand mobile 35 starts again from zero.

Pushing button P2 effects a change from state B to state D.

State D

When the chronograph mechanism 10 is in state D, the clutch 40 is engaged, while the brake 50*a* is active and the brake 50*b* is inactive.

The sweep hand 6 is stopped and indicates a measured time. After having been restored, the sweep hand 7 is moving and indicates a new time measurement that is in progress.

The time indicated by the sweep hand 6 can be the time taken by a motor driver to complete a first lap of a closed circuit. In this case, button P2 was pushed at the precise moment that the driver passed the timing initialisation point again. The sweep hand 7 times the second lap which the driver is in the process of completing. When the motor driver approaches the timing initialisation point, the respective positions of the sweep hands 6 and 7 can be compared in order to determine which of the motor driver's first and second laps was the fastest.

Pushing Button P2 in State D

When button P2 is pushed while the chronograph mechanism is in state D, the reversing mechanism 64 reverses the states of the brakes 50*a* and 50*b*. As a result, the brake 50*a* changes to the inactive state while the brake 50*b* changes to the active state. The sweep-hand mobile 35 is immediately immobilized and stops instantaneously in its current angular position. The brake 50*a* no longer immobilizes the sweep-hand mobile 30, which is returned to its predetermined angular position relative to the intermediate chronograph mobile 20 by the return device 55*a*.

Pushing button P2 further actuates the flyback mechanism 42 immediately after immobilization of the sweep-hand mobile 35 and unblocking of the sweep-hand mobile 30. The clutch 40 is disengaged for a brief moment, during which the restoring mechanism 41 restores the intermediate chronograph mobile 20. Only the sweep-hand mobile 30 follows the intermediate chronograph mobile 20 as it is restored. The clutch 40 then returns to the engaged state and a new time measurement involving only the sweep-hand mobile 30 starts again from zero.

Pushing button P2 effects a change from state D to state E.

State E

When the chronograph mechanism 10 is in state E, the clutch 40 is engaged, while the brake 50*a* is inactive and the brake 50*b* is active.

The sweep hand 7 is stopped and indicates a measured time. After having been restored, the sweep hand 6 is moving and indicates a new time measurement that is in progress.

Button P2 may have been pushed again at the precise moment at which the motor driver in the example passed the timing initialisation point again. In that case, the time indicated by the sweep hand 7 is the time taken by the motor driver to complete the second lap. The sweep hand 6 times the third lap, which the motor driver is in the process of completing.

Pushing Button P3 in State D

Pushing button P3 in state D actuates the flyback mechanism 42 but not the reversing mechanism 64. The brake 50*a* remains in its active state, while the brake 50*b* remains in its inactive state. The intermediate chronograph mobile 20 and the sweep-hand mobile 35 are restored together, and a new time measurement involving only the sweep-hand mobile 35 then starts again from zero.

Pushing button P3 in state D reinitializes the timing. It leaves the chronograph mechanism in state D.

The sweep-hand mobile 30 does not change angular position. For example, the hand 6 carried by the sweep-hand mobile 30 can indicate a measured reference time, for example the best lap time achieved thus far by the motor driver.

Pushing Button P1 in State D

When button P1 is pushed while the chronograph mechanism 10 is in state D, the clutch 40 returns to the disengaged state. The transmission between the watch movement 15 and the intermediate chronograph mobile 20 is broken. The sweep-hand mobile 35 and the intermediate chronograph mobile 20 stop together.

Pushing button P1 further activates the neutralization means 62, after which the brakes 50*a* and 50*b* are both inactive. The brake 50*a* no longer immobilizes the sweep-hand mobile 30, which is returned by the return device 55*a* to the predetermined angular position relative to the intermediate chronograph mobile 20. The sweep-hand mobile 35 is already in that predetermined angular position. The sweep hands 6 and 7 are superposed and stopped.

Pushing button P1 effects a change from state D to state C.

Pushing Button P2 in State E

When button P2 is pushed while the chronograph mechanism is in state E, the reversing mechanism 64 again reverses the state of the brakes 50*a* and 50*b*. The sweep-hand mobile 30 is immediately immobilized and stops instantaneously in its current angular position. The brake 50*b* no longer immobilizes the sweep-hand mobile 35, which is returned by the return device 55*b* to the predetermined angular position relative to the intermediate chronograph mobile 20.

Pushing button P2 further actuates the flyback mechanism 42, immediately after immobilization of the sweep-hand mobile 30 and unblocking of the sweep-hand mobile 35. The intermediate chronograph mobile 20 and the sweep-hand mobile 35 are restored, and a new time measurement involving only the sweep-hand mobile 35 then starts again from zero.

Pushing button P2 effects a change from state E to state D.

Pushing Button P3 in State E

Pushing button P3 in state E actuates the flyback mechanism 42 but not the reversing mechanism 64. The brake 50*a* remains in its inactive state, while the brake 50*b* remains in its active state. The intermediate chronograph mobile 20 and the sweep-hand mobile 30 are restored together, and a new time measurement involving only the sweep-hand mobile 30 then starts again from zero.

Pushing button P3 in state E reinitializes the timing. It leaves the chronograph mechanism in state E.

The sweep-hand mobile 35 does not change angular position. For example, the hand 7 carried by the sweep-hand mobile 35 can indicate a measured reference time, for example the best lap time achieved thus far by the motor driver.

Pushing Button P1 in State E

The consequence of pushing button P1 when the chronograph mechanism is in state E can be deduced from the preceding description of what occurs when button P1 is pushed while the chronograph mechanism 10 is in state D.

Pushing button P1 effects a change from state E to state C.

Pushing Button P2 in State C

When button P2 is pushed while the chronograph mechanism is in state C, the neutralization means 62 are deactivated and the configuration of the brakes 50*a* and 50*b* is determined by the reversing mechanism 64. As a result, the brake 50*a* changes to the active state, while the brake 50*b* remains in the inactive state.

Pushing button P2 further actuates the flyback mechanism 42 and therefore the restoring mechanism 41, immediately after immobilization of the sweep-hand mobile 30. The restoring mechanism 41 restores the intermediate chronograph mobile 20, which is followed by the sweep-hand mobile 35.

Pushing button P2 effects a change from state C to state F.

State F

When the chronograph mechanism 10 is in state F, the clutch 40 is disengaged, while the brake 50*a* is active and the brake 50*b* is inactive.

The sweep hand 6 is stopped and indicates a measured time. The sweep hand 7 is stopped at zero.

Pushing Button P2 in State F

When button P2 is pushed while the chronograph mechanism is in state F, the reversing mechanism 64 reverses the states of the brakes 50*a* and 50*b*. As a result, the brake 50*a* changes to the inactive state, while the brake 50*b* changes to the active state. The brake 50*a* no longer immobilizes the sweep-hand mobile 30, which is returned by the return device 55*a* to the predetermined angular position relative to the intermediate chronograph mobile 20. The sweep-hand mobile 30 thus joins at zero the intermediate chronograph mobile 20, which is already at zero.

Pushing button P2 effects a change from state F to state G.

State G

When the chronograph mechanism 10 is in state G, the clutch 40 is disengaged, while the brake 50*a* is inactive and the brake 50*b* is active.

The sweep hands 6 and 7 are stopped at zero.

Pushing Button P2 in State G

When button P2 is pushed while the chronograph mechanism is in state G, the reversing mechanism 64 reverses the states of the brakes 50*a* and 50*b*. The intermediate chronograph mobile 20 and the sweep-hand mobiles 30 and 35 remain together stopped at zero.

Pushing button P2 effects a change from state G to state H.

State H

When the chronograph mechanism 10 is in state H, the clutch 40 is disengaged, while the brake 50*a* is active and the brake 50*b* is inactive.

The sweep hands 6 and 7 are stopped at zero.

Pushing Button P2 in State H

When button P2 is pushed while the chronograph mechanism is in state H, the reversing mechanism 64 reverses the states of the brakes 50*a* and 50*b*. The intermediate chronograph mobile 20 and the sweep-hand mobiles 30 and 35 remain together stopped at zero.

Starting from state H, pushing button P2 effects a change back to state G.

Pushing Button P3 in States F, G and H

When the chronograph mechanism 10 is in any one of states F, G and H, pushing the third button P3 has no effect because the intermediate chronograph mobile 20 is already at zero and stopped.

Pushing Button P1 in States F, G and H

When button P1 is pushed while the chronograph mechanism 10 is in any of states F, G and H, the clutch 40 changes to the engaged state. Pushing button P1 further activates the neutralization means 62, after which the brakes 50*a* and 50*b* are both inactive.

Pushing button P1 effects a change from one of states F, G and H to state B.

Description of a Second Embodiment of the Invention

A chronograph mechanism according to a second embodiment of the invention is also proposed. The watch of FIG. 1 can be equipped therewith instead of with the chronograph mechanism 10 of FIGS. 3 and 4.

The chronograph mechanism according to the second embodiment of the invention is identical to the chronograph mechanism 10 of FIGS. 3 and 4, except that it does not have the control member 712.

In the following, any part of the chronograph mechanism according to the second embodiment that is mentioned is designated by the same reference numeral as the part that is identical thereto in the chronograph mechanism of FIGS. 3 and 4.

When button P2 of the chronograph mechanism according to the second embodiment is pushed, the only control member that is manoeuvred is the control member 713, which then has the same action on the coordination device 60 as in the embodiment of FIGS. 3 and 4, while there is no restoring of the intermediate chronograph mechanism 20 on the fly.

Figure 17:
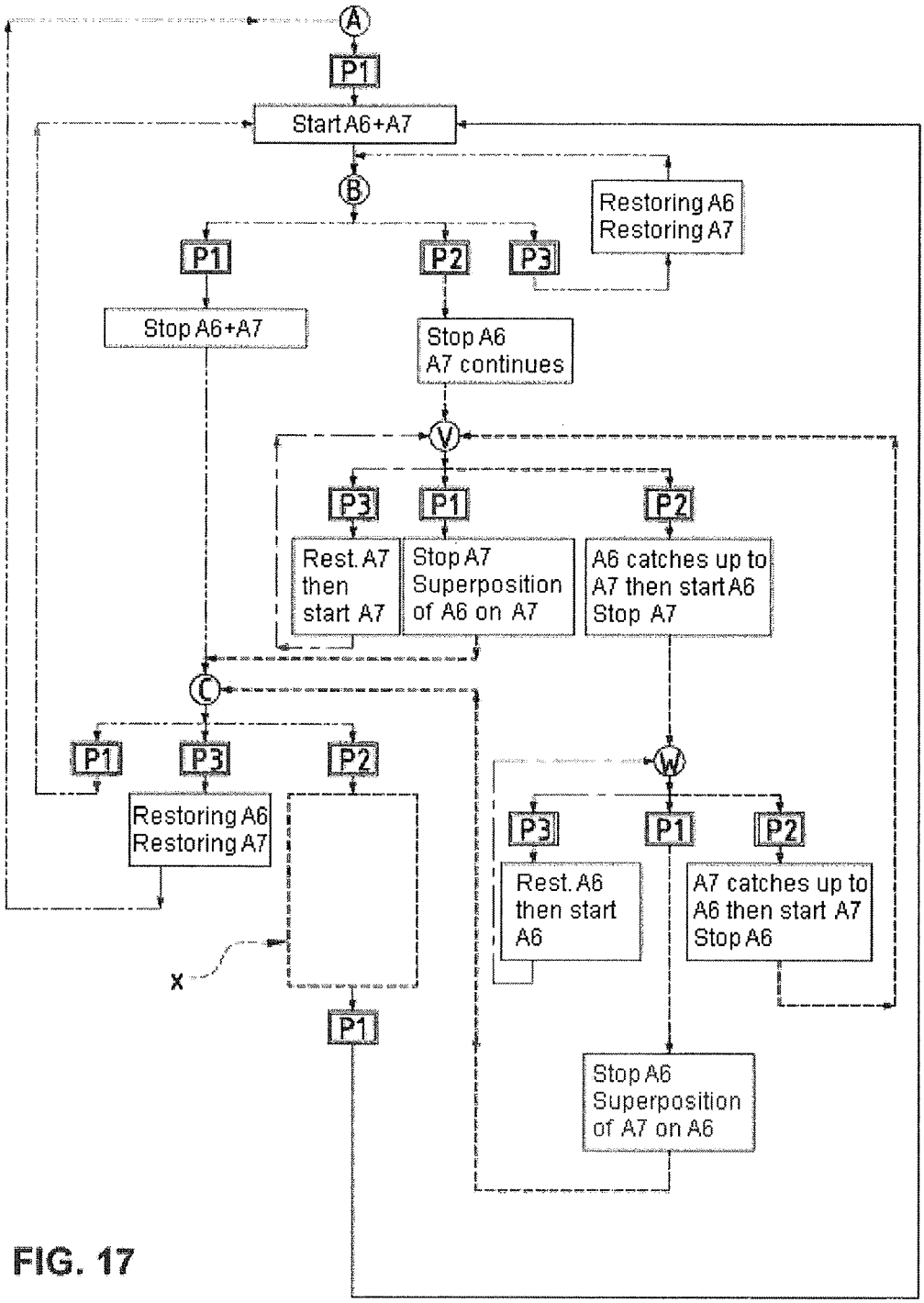
FIG. 17 is a synoptic diagram of the operating logic of a chronograph mechanism according to a second embodiment of the invention.

FIG. 17 is a synoptic diagram illustrating the operating logic of the chronograph mechanism according to the second embodiment of the invention. The same representation conventions, with the same meanings, are used therein as in FIG. 16.

A description of several states of the chronograph mechanism according to the second embodiment is shown in the table below.

| | Bottom sweep hand 6 (A6) | Top sweep hand 7 (A7) |
|---|---|---|
| State A | Stopped, at zero, unblocked | Stopped, at zero, unblocked |
| State B | Rotating | Rotating, superposed on sweep hand A6 |
| State C | Stopped anywhere, unblocked | Stopped, superposed on sweep hand A6, unblocked |
| State V | Stopped anywhere, blocked | Rotating |
| State W | Rotating | Stopped anywhere, blocked |

The chronograph mechanism according to the second embodiment can operate according to several modes, including a conventional timing type mode and an operating mode which allows the same time measurements to be carried out as with a rattrapante chronograph, but more simply and more reliably for the user. In the conventional timing type mode, the sweep hands 6 and 7 remain superposed and provide the same information, and they are to be considered as forming together the single sweep hand of a conventional chronograph. In the operating mode which allows the same time measurements to be carried out as a rattrapante chronograph, the sweep hands 6 and 7 are assigned to different time measurements, especially to different time measurements having the same start time.

The chronograph mechanism according to the second embodiment can be placed in the same states A, B and C as the chronograph mechanism of FIGS. 3 and 4. When the chronograph mechanism according to the second embodiment is in one of states A, B and C, pushing button P1 or pushing button P3 has the same consequences as in the case of the chronograph mechanism of FIGS. 3 and 4.

Pushing Button P2 in State B

When button P2 is pushed while the chronograph mechanism according to the second embodiment is in state B, the neutralization means 62 are deactivated and the configuration of the brakes 50*a* and 50*b* is determined by the reversing mechanism 64. As a result, the brake 50*a* changes to the active state, while the brake 50*b* remains in the inactive state. The sweep-hand mobile 30 is immediately immobilized and stops instantaneously in its current angular position. Driving of the intermediate chronograph mobile 20 via the clutch 40 is not interrupted and the sweep-hand mobile 35 continues the time measurement that is in progress.

Pushing button P2 effects a change from state B to state V.

State V

When the chronograph mechanism according to the second embodiment is in state V, the clutch 40 is engaged, while the brake 50*a* is active and the brake 50*b* is inactive.

The sweep hand 6 is stopped and indicates a measured time. The sweep hand 7 is moving and indicates the time measured by a time measurement that is in progress.

In a state V that directly follows a state B, the time measurement that is in progress, which measures a time indicated by the sweep hand 7, is a continuation of the time measurement which had taken place in state B. The time indicated by the sweep hand 6 can be, for example, an intermediate time during an event that is continuing. In a competition in which several competitors are taking part at the same time, the measured time indicated by the sweep hand 6 can also be, for example, the final time achieved by a competitor who has finished before one or more other competitors, who continue to be timed by means of the time measurement that is in progress.

Pushing Button P2 in State V

When button P2 is pushed while the chronograph mechanism according to the second embodiment is in state V, the reversing mechanism 64 reverses the states of the brakes 50*a* and 50*b*. As a result, the brake 50*a* changes to the inactive state, while the brake 50*b* changes to the active state. The sweep-hand mobile 35 is immediately immobilized and stops instantaneously in its current angular position.

In parallel, the return device 55*a* returns the sweep-hand mobile 30 to the predetermined angular position relative to the intermediate chronograph mobile 20, driving of which via the clutch 40 is not interrupted, so that the time measurement in progress during the preceding state V continues after the change to state W.

Following pushing of button P2, the sweep hand 6 catches up to the sweep hand 7 and replaces it in the indication of the measurement carried out by the time measurement in progress, while the sweep hand 7 stops.

Pushing button P2 effects a change from state V to state W.

State W

When the chronograph mechanism according to the second embodiment is in state W, the clutch 40 is engaged, while the brake 50*a* is inactive and the brake 50*b* is active.

The sweep hand 7 is stopped and indicates a measured time. The sweep hand 6 is moving and indicates the time measured by a time measurement that is in progress.

In a state W directly following a state V, the sweep hand 6 is assigned to the time measurement that is in progress, to which the sweep hand 7 was assigned in state V. The measured time indicated by the sweep hand 7 can be, for example, another intermediate time or, in the case of an event in which a number of competitors start at the same time, the final time achieved by a following competitor.

Pushing Button P2 in State W

When button P2 is pushed while the chronograph mechanism according to the second embodiment is in state W, the reversing mechanism 64 reverses the states of the brakes 50*a* and 50*b*. The sweep-hand mobile 30 is immediately immobilized and stops instantaneously in its current angular position.

In parallel, the return device 55*a* returns the sweep-hand mobile 35 to the predetermined angular position relative to the intermediate chronograph mobile 20, driving of which via the clutch 40 is not interrupted, so that the time measurement in progress during the preceding state W continues after the change to state V.

Following pushing of button P2, the sweep hand 7 catches up to the sweep hand 6 and replaces it in the indication of the time measurement in progress, while the sweep hand 6 stops.

Pushing button P2 effects a change from state W to state V.

In a state V directly following a state W, the sweep hand 7 is assigned to the time measurement in progress, to which the sweep hand 6 was assigned in state W. The measured time indicated by the sweep hand 6 can be, for example, another intermediate time or, in the case of an event in which a number of competitors start at the same time, the final time achieved by yet another competitor.

It is clear from the above that the chronograph mechanism according to the second embodiment allows the same time measurements to be carried out as a conventional rattrapante chronograph, using button P2 to effect changes of state between states B, V and W.

In a conventional rattrapante chronograph, it is necessary to push a button twice in succession in order to stop a secondary time measurement again after it has already been stopped at least once, during a main time measurement. The first of the two pushes is a preparatory push which serves to unblock the rattrapante so that it catches up to the sweep hand assigned to the main time measurement. After the first push, the second push can be applied in order to block the rattrapante again. In this respect, the user, for example absorbed in the event which is being timed, may forget to unblock the rattrapante by means of the first push before the moment at which he must normally apply the second push in order to determine the new stop time of the secondary time measurement. When that is the case, the user may apply the first push thinking that he is applying the second push, but he is irremediably no longer able to apply the second push at the correct moment.

The chronograph mechanism according to the second embodiment of the invention is more simple and more reliable to use than a conventional rattrapante chronograph in as much as a single push is sufficient to change from state V to state W or vice versa.

Pushing Button P1 in States V and W

When button P1 is pushed while the chronograph mechanism according to the second embodiment is in state V or in state W, the clutch 40 returns to the disengaged state. Pushing button P1 further activates the neutralization means 62, after which the brakes 50*a* and 50*b* are both inactive.

After pushing button P1 while the chronograph mechanism according to the second embodiment is in either of states V and W, the sweep-hand mobiles 30 and 35 are both in the predetermined angular position relative to the intermediate chronograph mobile 20, which is stopped. The sweep hands 6 and 7 are superposed and stopped.

Pushing button P1 effects a change from states V and W to state C. This push can be applied at the precise moment at which an event finishes in which intermediate times were indicated by changing to states V and W. When that is the case, the sweep hands 6 and 7 indicate the measurement of the total duration of the event, in state C following pushing of button P1.

Pushing Button P3 in States V and W

Pushing button P3 in either of states V and W actuates the flyback mechanism 42 but not the reversing mechanism 64. One of the brakes 50*a* and 50*b* remains in its active state and the other in its inactive state. The intermediate chronograph mobile 20 and the unblocked sweep-hand mobile 30 or 35 are restored together, and then a new time measurement involving only the sweep-hand mobile 30 or 35 starts again from zero.

Pushing button P3 reinitializes the time measurement. It leaves the chronograph mechanism according to the second embodiment in state V or in state W, as the case may be.

Pushing Button P2 in State C

In FIG. 17, the reference sign X denotes a group of states which are reached by pushing button P2 in state C. In each of these states, the clutch 40 is disengaged, while one of the brakes 50*a* and 50*b* is active.

When button P1 is pushed while the chronograph mechanism according to the second embodiment is in any state of the group X, the clutch 40 changes to the engaged state. Pushing button P1 further activates the neutralization means 62, after which the brakes 50*a* and 50*b* are both inactive.

Pushing button P1 effects a change from one of the states of the group X to state B.

The invention is not limited to the embodiments described hereinabove. In particular, in the first embodiment of the invention, button P3 can be omitted without departing from the scope of the invention, although the presence of button P3 can be advantageous in terms of the possible uses offered by the chronograph mechanism. Likewise, the coordination device 60 can be without the neutralization means 62 without departing from the scope of the invention, although the presence of the neutralization means 62 can be advantageous in terms of the possible uses offered by the chronograph mechanism.

The invention claimed is:

1. A chronograph mechanism for a timepiece comprising a watch movement, the chronograph mechanism comprising:

a first sweep-hand mobile which is provided for carrying a first sweep hand for indicating a first measured time;

a first brake configured to angularly immobilize the first sweep-hand mobile;

a second sweep-hand mobile which is provided for carrying a second sweep hand for indicating a second measured time and which rotates on the same axis of rotation as the first sweep-hand mobile;

a second brake configured to angularly immobilize the second sweep-hand mobile;

an intermediate chronograph mobile which rotates on the same axis of rotation as the first and second sweep-hand mobiles and is arranged to transmit a drive from the watch movement to the first and second sweep-hand mobiles;

a first return device configured to return the first sweep-hand mobile to a first predetermined angular position relative to the intermediate chronograph mobile in the absence of angular immobilization of the first sweep-hand mobile by the first brake;

a second return device configured to return the second sweep-hand mobile to a second predetermined angular position relative to the intermediate chronograph mobile in the absence of angular immobilization of the second sweep-hand mobile by the second brake; and a control system including a coordination device which is arranged to maintain the first and second brakes in two alternative configurations, including, a first configuration in which the first brake is in an inactive state, thereby allowing the first sweep-hand mobile to rotate freely, and in which the second brake is in an active state, thereby angularly immobilizing the second sweep-hand mobile, and a second configuration in which the second brake is in an inactive state, thereby allowing the second sweep-hand mobile to rotate freely, and in which the first brake is in an active state, thereby angularly immobilizing the first sweep-hand mobile.

2. The chronograph mechanism according to claim 1, further comprising:

a restoring device for restoring the intermediate chronograph mobile.

3. The chronograph mechanism according to claim 1, further comprising:

a clutch for coupling the intermediate chronograph mobile to the watch movement, the control system being configured to place the clutch alternately in an engaged state and in a disengaged state;

a restoring device for restoring the intermediate chronograph mobile; and a flyback mechanism arranged to restore the intermediate chronograph mobile on the fly by disengaging said clutch for a brief moment and actuating the restoring device during the brief moment.

4. The chronograph mechanism according to claim 1, wherein the coordination device includes a first column wheel for selecting the state of the first brake from the inactive state and the active state of the first brake, each maneuver of the first column wheel by one step reversing the state of the first brake, and a second column wheel for selecting the state of the second brake from the inactive state and the active state of the second brake, each maneuver of the second column wheel by one step reversing the state of the second brake, the first and second column wheels being out of phase by one step relative to one another so as to place the first and second brakes in opposite states, the control system being arranged to actuate the first and second column wheels together by one step when instructed to reverse the configuration of the first and second brakes between the first and second configurations.

5. The chronograph mechanism according to claim 1, wherein the coordination device is arranged to maintain the first and second brakes in three alternative configurations, including the first configuration, the second configuration, and a third configuration in which the first and second brakes are in their respective inactive states, allowing the first and second sweep-hand mobiles to rotate freely.

6. The chronograph mechanism according to claim 1, further comprising:

a clutch for coupling the intermediate chronograph mobile to the watch movement, the control system being configured to place the clutch alternately in an engaged state and in a disengaged state.

7. The chronograph mechanism according to claim 6, wherein the control system further includes a first control mechanism configured to convert a first manual instruction into a first actuation which reverses the state of the clutch between the engaged state and the disengaged state, and a second control mechanism configured to convert a second manual instruction into a second actuation which reverses the configuration of the first and second brakes between the first and second configurations.

8. The chronograph mechanism according to claim 7, further comprising:

a restoring device for restoring the intermediate chronograph mobile; and a flyback mechanism arranged to restore the intermediate chronograph mobile on the fly by disengaging said clutch for a brief moment and actuating the restoring device during the brief moment, wherein the second control mechanism is configured to convert the second manual instruction into said second actuation and a third actuation which follows the second actuation and leads the flyback mechanism to restore the intermediate chronograph mobile on the fly, unless the intermediate chronograph mobile is already at zero.

9. The chronograph mechanism according to claim 8, wherein the control system is configured to convert a third manual instruction into the third actuation without causing the second actuation.

10. The chronograph mechanism according to claim 7, further comprising:

a restoring device for restoring the intermediate chronograph mobile, wherein the second control mechanism is configured to convert the second manual instruction into the second actuation without causing a third actuation which leads the restoring device to restore the intermediate chronograph mobile.

11. The chronograph mechanism according to claim 7, wherein the first control mechanism is configured to convert the first manual instruction into the first actuation and another actuation which brings the first and second brakes into a third configuration in which the first and second brakes are in their respective inactive states, unless the first and second brakes are already in the third configuration, while the second actuation brings the first and second brakes out of the third configuration, unless the first and second brakes are already in one of the first and second configurations.

12. The chronograph mechanism according to claim 7, further comprising:

a restoring device for restoring the intermediate chronograph mobile, wherein the control system is configured to convert a third manual instruction into a third actuation which leads the restoring device to restore the intermediate chronograph mobile, unless the intermediate chronograph mobile is already at zero.

13. A timepiece, comprising:

a chronograph mechanism according to claim 1, wherein the intermediate chronograph mobile is configured to receive a drive from the watch movement.

* * * * *